US007815749B2

(12) United States Patent
Yokoyama

(10) Patent No.: US 7,815,749 B2
(45) Date of Patent: Oct. 19, 2010

(54) METHOD FOR MANUFACTURING SEMI-HARD MAGNETIC MATERIAL AND SEMI-HARD MAGNETIC MATERIAL

(75) Inventor: Shinichiro Yokoyama, Yonago (JP)

(73) Assignee: Hitachi Metals, Ltd., Tokyo (JP)

( * ) Notice: Subject to any disclaimer, the term of this patent is extended or adjusted under 35 U.S.C. 154(b) by 517 days.

(21) Appl. No.: 11/770,284

(22) Filed: Jun. 28, 2007

(65) Prior Publication Data

US 2008/0000560 A1 Jan. 3, 2008

(30) Foreign Application Priority Data

Jun. 29, 2006 (JP) ..... 2006-179425

(51) Int. Cl.
*H01F 1/047* (2006.01)
*H01F 1/147* (2006.01)

(52) U.S. Cl. ..... 148/121; 148/120

(58) Field of Classification Search ..... None
See application file for complete search history.

(56) References Cited

U.S. PATENT DOCUMENTS 4,536,229 A 8/1985 Jin et al.
5,431,746 A * 7/1995 Manning et al. ..... 148/122
5,527,399 A * 6/1996 Manning et al. ..... 148/120
5,685,921 A * 11/1997 Dulmaine ..... 148/120

FOREIGN PATENT DOCUMENTS

| | | |
|---|---|---|
| JP | 60-116109 | 6/1985 |
| JP | 2000-504069 A | 4/2000 |
| WO | WO 97/28286 | 8/1997 |

* cited by examiner

*Primary Examiner*—John P Sheehan
(74) *Attorney, Agent, or Firm*—Sughrue Mion, PLLC

(57) ABSTRACT

The present invention provides a method of manufacturing a semi-hard magnetic material comprising, sequentially: preparing a raw material consisting essentially of 10.0 to 25.0% of Ni, 2.0 to 6.0% of Mo and the balance being Fe and inevitable impurities, in mass %; heat-treating or hot-working the raw material so that it has not less than 90% of martensitic structure; cold-working the material at a reduction of area of not less than 50% so that it has an extended structure including not less than 95% of a martensitic structure; and heat-treating the material in a range of 400 to 570° C. so as to generate more than 0% but less than 30.0% of reverse-transformed austenitic structure. The semi-hard magnetic material manufactured using this method can possess a coercive force of 1000 to 5600 A/m.

13 Claims, 16 Drawing Sheets

METHOD FOR MANUFACTURING SEMI-HARD MAGNETIC MATERIAL AND SEMI-HARD MAGNETIC MATERIAL

BACKGROUND OF THE INVENTION (1) Field of the Invention

The present invention relates to a method of manufacturing a semi-hard magnetic material, for example used as a bias material for a crime prevention sensor, and to a semi-hard magnetic material.

(2) Description of Related Art

A magnetic sensor tag attached to goods at large-sized mass merchandisers or the like for preventing burglary (which is referred to as a "crime prevention sensor" hereinafter) is composed of a resonating magnetostrictive strip and a bias which gives a magnetic field thereto.

The system of the crime prevention sensor has a function that the magnetostrictive strip resonates and an alarm sounds when somebody attempts to take a product out of a shop without paying a charge. When a charge is duly paid, however, the resonance frequency is necessary to be changed so as not cause the magnetostrictive strip to resonate. To change the resonance frequency of the magnetostrictive strip, it is necessary to change the intensity of the magnetic field that the bias gives to the magnetostrictive strip. More specifically, the bias needs to remain in a magnetized state until a charge is paid, but be changed to a demagnetized state after the charge is paid.

For this reason, after the payment, an operation of demagnetizing the bias is performed using a demagnetization apparatus mounted on a counter stand of a register. In this case, if the coercive force of the material which composes the bias is too large, it is difficult to realize demagnetization. On the contrary, if the coercive force is too low, it is easy to realize demagnetization, but there is a problem that the magnetic field given to the magnetostrictive strip in the magnetized state becomes small. Furthermore, when a tiny reverse magnetic field is applied to the bias, the function as the crime prevention sensor is lost and this deteriorates the reliability.

As the material for the above described bias, a semi-hard magnetic material which has an intermediate coercive force between a hard magnetic material which has a high coercive force of not less than 8000 A/m (permanent magnet) and a soft magnetic material which has a low coercive force of not more than 800 A/m is preferably used.

More specifically the hard magnetic material preferably has a coercive force $H_c$ of 1000 to 5600 A/m, more preferably in a range of 1200 to 4000 A/m, and preferably it has a remarkable difference between ON and OFF, that is in a magnetized stats and a demagnetized state. Therefore, the hard magnetic material preferably has magnetic characteristics which include a high saturation magnetic flux density $B_s$ and residual magnetic flux density $B_r$ as well as a high squareness ratio $B_r/B_s$ on a B—H curve.

The semi-hard magnetic material may be also used for a relay or motor in addition to the above described crime prevention sensor.

As one of such semi-hard magnetic materials, JP-A-60-116109 discloses an Fe—Ni—Mo semi-hard magnetic material composed of 16.0 to 30.0% of Ni, 3.0 to 10.0% of Mo and the balance being substantially Fe in mass % and a manufacturing method thereof.

According to this document, rolling, drawing and swaging processes at a reduction ratio of 20 to 80% are performed. As for a metallic structure then, a martensitic structure increases according to a degree of work and transforms into two-phase structure of austenitic and martensitic structure. The document further discloses processes of holding the austenitic and martensitic structures at a temperature of 600 to 700° C. for 10 minutes to 5 hours for generating reverse transformed austenite to transform it into a mixed structure of 30 to 70% of austenitic structure and martensitic structure, then reworking it at a reduction of 50 to 98%, and then subjecting to final ageing by holding it at a temperature of 500 to 600° C. for 10 minutes to 5 hours to generate a reverse transformed austenitic structure for adjusting it to have 30 to 70% of austenitic structure in mass %.

On the other hand, JP-A-2000-504069 proposes a method of manufacturing an Fe—Ni—Mo semi-hard magnetic material composed of 16.0 to 30.0% of Ni, 3.0 to 10.0% of Mo, and the balance being substantially Fe in mass %, comprising heating the material of a martensitic structure at approximately 475 to 625° C. for approximately 4 minutes to generate reverse transformed austenite, and then cold-rolling it to extend the reverse transformed austenitic structure into an extended structure so as to obtain a desired coercive force (not less than 2400 A/m).

In the above two proposals, reverse transformed austenite is intentionally generated even in an intermediate process to obtain a mixed structure of martensitic and austenitic structures, and thus a final mixed structure of martensitic and austenitic structure is obtained.

According to JP-A-60-116109, in order to generate 30 to 70% austenitic structure in the martensitic structure, the mixed structure of the austenitic and martensitic structures is kept in each process and finally adjusted to a desired metallic structure through ageing. However, the metallic structure before the final ageing is apt to change in each process, for example due to its thermal history, and the metallic structure is further changed by a rolling reduction in each path of cold rolling, therefore, a fixed final ageing condition may cause a variation in the magnetic characteristics.

Furthermore, according to JP-A-2000-504069, the generated reverse transformed austenite is cold rolled and transformed into an extended structure of reverse transformed austenite so that a layered structure of martensite and reverse transformed austenite is obtained. However, according to present inventor's investigations, when the reverse transformed austenitic structure is subjected to cold rolling, it transforms into martensite at a minimal rolling reduction and the amount of transformation thereof also changes depending on the temperature of rolls which contact the material (rolling temperature). Therefore, the technique of adjusting the amount of reverse transformed austenite using the cold rolling process as the final process requires a high-level manufacturing technique.

In view of the above described problems, it is an object of the present invention to provide a method of manufacturing a semi-hard magnetic material capable of efficient industrial production with relatively easy adjustment of an amount of reverse transformed austenitic structure. Furthermore, it is another object of the present invention to provide a semi-hard magnetic material which has a desired material structure and magnetic properties, such as coercive force and squareness ratio.

BRIEF SUMMARY OF THE INVENTION

The inventor has studied an optimal method to obtain a semi-hard magnetic material having a desired coercive force by mixing a ferromagnetic martensitic structure and paramagnetic reverse transformed austenitic structure.

As a result, the inventor has come up with the present invention by discovering that desired magnetic properties can be obtained most stably using a method of: causing at least 95% of the structure become a single phase of a substantially martensitic structure during processes from heat treatment or hot working, which is performed prior to cold working, and before heat treatment for generating a paramagnetic reverse transformed austenitic structure, which determines a magnetic characteristics, especially coercive force; and then finally generating paramagnetic reverse transformed austenitic structure which determines the magnetic characteristics.

Furthermore, the inventor has examined a relationship between the structure of the semi-hard magnetic material, and the residual magnetic flux density and squareness ratio. As a result, he discovered that a high residual magnetic flux density and squareness ratio can be obtained by precipitating finely an intermetallic compound which makes a structure high hard. Thus, he has examined the heat treatment temperature and holding time to obtain a high hardness structure during heat treatment generating reverse transformed austenite. Thus, he has come up with the present invention.

One aspect of the present invention provides a method of manufacturing a semi-hard magnetic material comprising:

a step of preparing a raw material for the semi-hard magnetic material consisting essentially of 10.0 to 25.0% of Ni, 2.0 to 6.0% of Mo and the balance being Fe and inevitable impurities, in mass %;

a step of heat treating or hot working the raw material so that it has not less than 90% of martensitic structure;

a step of cold working the material at a reduction of area of not less than 50% so that it has an extended structure including not less than 95% of martensitic structure; and a step of heat treating the material in a range of 400 to 570° C. so as to generate more than 0% but less than 30.0% of reverse-transformed austenitic structure.

The amount of Ni in the method is preferably 15.0 to 22.0% in mass %.

Furthermore, the heat treatment or hot working applied to the semi-hard magnetic material in the method is preferably performed at 800 to 1150° C.

More preferably, the heat treatment for generating reverse transformed austenite is performed in a range of 470 to 530° C., and a holding time of the heat treatment is not less than 10 minutes.

Another aspect of the present invention provides a semi-hard magnetic material consisting essentially of: 10.0 to 25.0% of Ni, 2.0 to 6.0% of Mo and the balance being Fe and inevitable impurities; in mass %, wherein the material comprises martensitic structure and reverse transformed austenitic structure, wherein a ratio of the reverse transformed austenitic structure in relation to a whole metallic structure is more than 0% but less than 30.0%, and wherein the material has a coercive force Hc being 1000 to 5600 A/m.

Vicker's hardness of the semi-hard magnetic material is preferably not less than 400 Hv and a ratio $B_r/B_{8000}$ of a residual magnetic flux density Br(T) in relation to a magnetic flux density $B_{8000}$(T) in a magnetic field of 8000 A/m is not less than 0.70.

More preferably, the semi-hard magnetic material contains 15.0 to 22.0% of Ni in mass %.

According to the present invention, the final manufacturing process of the semi-hard magnetic material is the heat treatment generating reverse transformed austenite, whereby it facilitates the adjustment of the coercive force in comparison with the case where the final process is cold rolling. Therefore, the present invention provides an important technique in industrially manufacturing a semi-hard magnetic material.

Furthermore, since the semi-hard magnetic material of the present invention can obtain a coercive force in a desired range, a high residual magnetic flux density and a squareness ratio by adjusting the amount of reverse transformed austenite and hardness, the semi-hard magnetic material can be used, for example as a bias material of a crime prevention sensor.

DETAILED DESCRIPTION OF THE INVENTION

Figure 1:
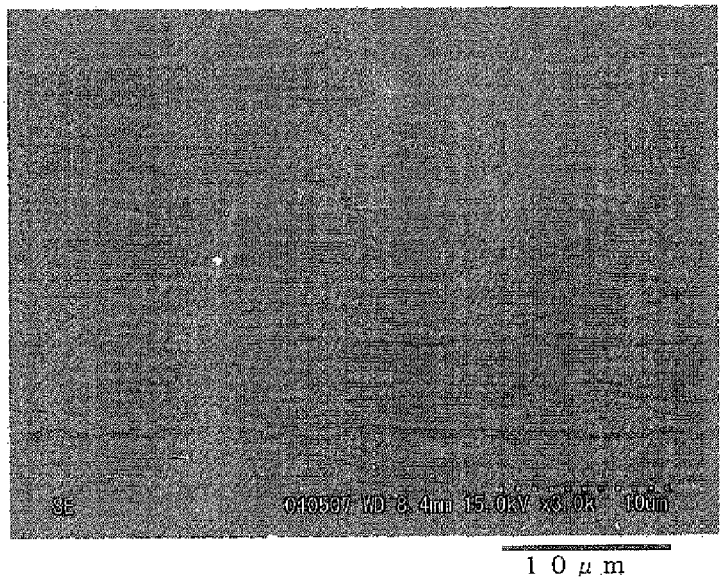
FIG. 1 is a cross-sectional electron microphotograph of a plate material manufactured by the method of the present invention.

As described above, an important feature of the present invention is to employ a manufacturing method in which an amount of reverse transformed austenite and eventually magnetic properties of the semi-hard magnetic material are adjusted only through a heat treatment process of generating reverse transformed austenite after final cold rolling, and thereby simplifies the process of manufacturing the semi-hard magnetic material, while the method does not include a process of intentionally generating reverse transformed austenite in the middle of a process of manufacturing a semi-hard magnetic material or a process of controlling the shape of austenitic structure through cold rolling after the heat treatment generating reverse transformed austenite.

Hereinafter, reasons for prescribing the method of manufacturing a semi-hard magnetic material and the semi-hard magnetic material of the present invention will be described.

First, a reason for prescribing the semi-hard magnetic material in the manufacturing method of the present invention and chemical components of the semi-hard magnetic material of the present invention will be described. The content of each element indicated is by mass %.

Ni: 10.0 to 25.0%

Ni is an indispensable element for the present invention to generate a paramagnetic austenitic structure through heat treatment generating reverse transformed austenite and to adjust coercive force of the semi-hard magnetic material. When the amount of Ni is lower than 10.0%, the temperature ($M_s$ point), at which transformation from austenite to martensite starts in the process in which reverse transformed austenite generated during heat treatment is cooled down to the room temperature, increases. As a result, there is a worry that most of austenite generated during heat treatment generating reverse transformed austenite may be transformed into martensite, and the adequate amount of austenite may not be left after the heat treatment generating reverse transformed austenite. Therefore, a lower limit of the amount of Ni is prescribed to be 10.0%. On the other hand, when the upper limit of the amount of Ni exceeds 25.0%, the reverse transformed austenite is stabilized but the residual magnetic flux density $B_r$ of the semi-hard magnetic material drops. Therefore, the upper limit of the amount of Ni is prescribed to be 25.0%. A more desirable range of the amount of Ni is 15.0 to 22.0%.

Mo: 2.0 to 6.0%

Mo is an element effective in stabilizing austenite generated through reverse transformation from martensite. Furthermore, Mo is finely precipitated into a structure as an intermetallic compound with Ni, so that it increases hardness of the semi-hard magnetic material and eventually improves a residual magnetic flux density and squareness ratio of the semi-hard magnetic material. However, when it is less than 2.0%, both effects of austenite stabilization and of precipitation as an intermetallic compound become small. On the contrary, when it exceeds 6.0%, the residual magnetic flux density $B_r$ of the semi-hard magnetic material lowers. Therefore, a range of 2.0 to 6.0% is prescribed, From a viewpoint of fine precipitation of an intermetallic compound to increase hardness of the semi-hard magnetic material, a more preferable range of Mo is 3.0 to 5.5%.

Balance: Fe and Inevitable Impurities

The reason why Fe is substantially used as the balance is that phase transformation of an Fe alloy needs to be used to mix a ferromagnetic martensitic structure (body-centered cubic lattice) and paramagnetic austenitic structure (face-centered cubic lattice) in the semi-hard magnetic material of a single chemical composition.

The semi-hard magnetic material of the present invention naturally includes inevitable impurities such as C, Si, Mn, P, S, O or N. These impurity elements are preferably regulated so as to be in ranges of C≦0.10%, Si≦1.0%, Mn≦1.0%, P≦0.10%, S≦0.10%, O≦0.010%, N≦0.010%, as the ranges do not particularly affect the magnetic properties, such as saturation magnetic flux density $B_s$, residual magnetic flux density $B_r$, squareness ratio $B_r/B_s$, and coercive force $H_c$ of the semi-hard magnetic material.

Next, the reason for prescribing the manufacturing process of the present invention will be described.

The most characteristic aspect of the manufacturing method of the present invention resides in that a single phase of not less than 90% of substantially martensitic structure is maintained during processes from heat treatment or hot working carried out prior to cold working to a process immediately before heat treatment for generating reverse transformed austenite which determines a magnetic properties, and that paramagnetic reverse transformed austenitic structure is generated through heat treatment which is finally carried out for generating reverse transformed austenite that determines the magnetic properties.

The amount of martensite which will be explained below is calculated based on an X-ray integral intensity ratio. The method of calculating the amount of the structure will be shown below together with the method of calculating reverse transformed austenitic structure which will be described later.

<Calculating Method of Structure>

For example, not less than 90% of martensitic structure refers to a structure in which Xα(%) expressed by next Expressions (1) to (3) becomes not less than 90%.

Furthermore, when the present invention refers to an "amount of reverse transformed austenite (or the amount of austenite)", this refers to Xγ(%) expressed by Expression (2).

$$X\alpha(\%)=100\times\{\Sigma I\alpha/(\Sigma I\alpha+\Sigma I\gamma)\} \quad (1)$$

$$X\gamma(\%)=100-X\alpha(\%) \quad (2)$$

$$\Sigma I\alpha=I\alpha_{(110)}+I\alpha_{(200)}+I\alpha_{(211)} \quad (3)$$

$$\Sigma I\gamma=I\gamma_{(111)}+I\gamma_{(200)}+I\gamma_{(220)}+I\gamma_{(311)} \quad (4)$$

where $I\alpha_{(110)}$, $I\alpha_{(200)}$, $I\alpha_{(211)}$, $I\gamma_{(111)}$, $I\gamma_{(200)}$, $I\gamma_{(220)}$, $I\gamma_{(311)}$, shown in Expressions (3) and (4) are integration of diffraction intensity of the respective surfaces of α(110), α(200), α(211) surfaces of the martensitic structure and γ(111), γ(200), γ(222), γ(311) surfaces of the austenitic structure when the respective materials are electrolytically polished in the surfaces and subjected to X-ray diffraction.

The semi-hard magnetic material having the above described composition is adjusted to have not less than 90% of a martensitic structure through heat treatment or hot working.

In order to form not less than 90% of martensitic structure, the material is heated to a sufficiently high temperature to cause martensitic transformation and cooled at a cooling rate higher than that of air cooling so that the metallic structure can be transformed to martensite. Therefore, heating may be performed as only heat treatment, only hot working, or combination of heat treatment and hot working, according to the weight or size of the product. When the weight and size are large, air blast cooling which increases the cooling rate may be employed. Air cooling may as well be used in the case of a sheet material having a thickness of 1.5 to 5.0 mm, such as hot rolled material.

Furthermore, since water cooling or the like that causes excessive deformation in the cooling process requires a process of correcting the deformation before cold working of post-processing, air-cooling, air blast cooling or mist cooling of spraying a liquid are preferable.

The heating temperature during the heat treatment or hot working is preferably more than 700° C. This is because it is easy to adjust the metallic structure having not less than 90% of martensitic structure when the material is cooled with a cooling rate not less than that of air cooling after being heated to a temperature exceeding 700° C. A temperature of not leas than 800° C. is preferable, where the metallic structure can be more reliably adjusted to structure having not less than 90% of martensitic structure.

Furthermore, the upper limit of the heating temperature may be 1200° C., more preferably 1150° C., since no greater effect of forming martensitic structure can be expected even when the material is heated more than 1200° C.

When the heat treatment is performed, heating temperature may be 800 to 1000° C., and holding time may be 0.5 to 5.0 hours, while hot rolling temperature is optimal to be about 900 to 1150° C. in the case where the hot working, such as hot rolling, is performed.

Next, the material adjusted to have not less than 90% of martensitic structure is subjected to cold working at a reduction of area of not less than 50% and the structure is transformed into an extended structure which has not less than 95% of martensitic structure.

The reason why the reduction of area is set to not less than 50% is to maintain or enlarge the amount of martensitic structure than that after the heat treatment or hot working process and to sufficiently elongate the metallic structure into an extended structure. When the reduction of area is high, there are effects of increasing the driving force of reverse transformation from martensite to austenite and increasing the number of precipitation sites of an intermetallic compound. The reduction of area is preferably not less than 70% and more preferably not less than 90%.

Here, the reason for prescribing the structure of the material before heat treatment for generating reverse transformed austenite in the method of the present invention for manufacturing a semi-hard magnetic material will be described.

A first reason why the extended structure is used as the structural shape of the material is that this structure is necessary to allow austenite generated at a high temperature to stably exist at a room temperature through following heat treatment for generating reverse transformed austenite. The stability of the reverse transformed austenite generated at a high temperature is related to a diameter of crystal grains. As the diameter of crystal grains decreases, the resistance against martensite transformation increases and thereby stability increases.

An extended structure with small crystal grains is suitable for use in stabilizing reverse transformed austenite. On the contrary, since a material having a recrystallized structure through hot working or heat treatment after hot working has large crystal grains, reverse transformed austenite generated at a high temperature hardly becomes stable. Therefore, the structural shape of the material is prescribed to be an extended structure.

A second reason why the structural shape of the material is made to be extended is that this anisotropic structure is necessary to obtain high residual magnetic flux density $B_r$ and squareness ratio $B_r/B_{8000}$. Moreover, the reason why the structure of the material is made to be a structure having not less than 95% of martensitic structure is that this structure is necessary to obtain a high residual magnetic flux density $B_r$. More preferably, the martensitic structure is not less then 98%.

As an example of obtaining a plate material having not less than 95% of extended martensitic structure, it is recommendable to: apply heat treatment to a plate material prepared through hot rolling at a high temperature of not less than 1000° C. and wound in a coil; then leave it in a batch furnace having a temperature of 800° C. for 0.5 to 5.0 hours and then cooling it to obtain a recrystallized martensitic structure; and then applying cold rolling at a reduction of area not less than 90% to extend the martensitic structure finely.

Since the material after hot rolling often has a recrystallized structure through dynamic recrystallization, it is possible to omit the heat treatment process using a batch furnace when trying to shorten the process for manufacturing the material.

When there is a possibility that work hardening during cold working may cause cracks at the end of the material, a heat treatment process may be inserted in the middle of the cold working process (this heat treatment is hereinafter referred to as "intermediate heat treatment"). In this case, the intermediate heat treatment is the heat treatment according to the present invention.

When the intermediate heat treatment is performed using a batch furnace, the production efficiency of the material lowers considerably. Therefore, the intermediate heat treatment is preferably performed with a continuous furnace and the materials are preferably passed one by one through the heating furnace adjusted so that the temperature of the material becomes not lower than 800° C.

By carrying out the intermediate heat treatment, the plate material can be adjusted to have a recrystallized martensitic structure. In case where the intermediate heat treatment is performed, the material may be subjected to cold working after the intermediate heat treatment and transformed into an extended martensitic structure again. The reduction of area by the cold working after the intermediate heat treatment is not less than 90%. In other words, the thickness of the plate to be subjected to the intermediate heat treatment may be determined so that the final reduction of area becomes not less than 90% through cold working to the final thickness.

Using the above described method, a plate material having not less than 95% of martensitic structure can be obtained.

Next, the reason why the temperature range of heat treatment for generating reverse transformed austenite is prescribed to be 400 to 570° C. will be described. This heat treatment process generating austenite is a final process.

The heat treatment for generating reverse transformed austenite is an important process to adjust the amount of austenitic structure in the semi-hard magnetic material and eventually adjust the coercive force of the semi-hard magnetic material. Furthermore, this heat treatment also plays the role as an ageing treatment to cause an intermetallic compound to be precipitated along with the generation of reverse transformed austenite, and is an important process to adjust the residual magnetic flux density and the squareness ratio of the semi-hard magnetic material by precipitation of this intermetallic compound.

According to investigations conducted by the inventor, it is necessary to adjust the amount of reverse transformed austenite to a range of less than 30.0% to obtain a coercive force in a range of 1000 to 5600 A/m, for example required for a bias material for a crime prevention sensor. Furthermore, in order to obtain a coercive force of 1200 to 4000 A/m which is a more preferable range, the amount of reverse transformed austenite may be adjusted to a range of less than 30.0% (not including 0%) and more preferably adjusted to a range of 5.0 to 25.0%.

The reason why the lower limit of the temperature of heat treatment for generating reverse transformed austenite is set to 400° C. is that reverse transformed austenite is not generated at a temperature less than 400° C. and the effect of increasing the coercive force to 1000 A/m is small. Furthermore, at a temperature less than 400° C., the effect of precipitating an intermetallic compound is also small and moreover the effect of increasing the residual magnetic flux density and the squareness ratio is small. However, in the range of heat treatment temperature of 400 to 470° C., an amount of reverse transformed austenite may not less than 5.0% which is a preferable range, even if reverse transformed austenite is generated. Therefore, the lower limit of the heat treatment temperature is preferably 470° C. in order to ensure that the amount of reverse transformed austenite is not less than 5.0%.

On the other hand, the reason why the upper limit of the temperature of the heat treatment for generating reverse transformed austenite is set to 570° C. is that when the temperature of heat treatment exceeds 570° C., recrystallization starts, so that the extended anisotropic structure thereby starts to collapse, and the residual magnetic flux density and the squareness ratio decreases. Therefore, the upper limit of the temperature of the heat treatment for generating reverse transformed austenite is prescribed to be 570° C. However, when the temperature of the heat treatment ranges from 530 to 570° C., the amount of reverse transformed austenite easily becomes close to 30.0% and the residual magnetic flux density and the squareness ratio may decrease. Therefore, the upper limit of the temperature of the heat treatment for generating reverse transformed austenite is more preferably 530° C. The upper limit of the temperature is, further preferably, 490 to 520° C.

Next, the reason why the holding time of the heat treatment for generating reverse transformed austenite is set to not less than 10 minutes is that both of generation of reverse transformed austenite and precipitation of an intermetallic compound are insufficient when the holding time is less than 10 minutes, and the coercive force and the squareness ratio in the desired range are not obtained. A more preferable holding time is not less than 30 minutes. Although the upper limit of the holding time of the heat treatment for generating reverse transformed austenite is not especially prescribed, it is preferably set to not more than 5 hours as a range that does not degrade the productivity of the semi-hard magnetic material.

The heat treatment for generating reverse transformed austenite which becomes the final process can be performed with the plate material wound in a coil and placed in a batch furnace. Furthermore, the heat treatment may also be performed in an anti-oxidation atmosphere of argon, nitrogen, hydrogen or the like or in vacuum. Furthermore, the cooling after the heat treatment may be air cooling or air blast cooling of spraying an argon or nitrogen gas.

Next, the reason for prescribing the magnetic characteristics of the semi-hard magnetic material of the present invention will be described. The reason why the range of coercive force Hc is prescribed to be a range of 1000 to 5600 A/m is that this range is a range required as, for example, a bias material for a crime prevention sensor. 1200 to 4000 A/m is more preferably.

Furthermore, as the preferable range, the ratio $B_r/B_{8000}$ of a residual magnetic flux density Br(T) in relation to a magnetic flux density $B_{8000}$(T) in magnetic field 8000 A/m is decided to be not less than 0.70, because this range is a preferable range in which the difference between ON and OFF is clear between a magnetized condition and a demagnetized condition, and is a preferable range used as a bias material for a crime prevention sensor. More preferably, the ratio $B_r/B_{8000}$ is not less than 0.80. Furthermore, although the present invention does not particularly prescribe the range of residual magnetic flux density Br, the range is preferably not less than 1.0 T to be used, for example, as a bias material for a crime prevention sensor.

Next, the reason for prescribing the structure of the semi-hard magnetic material of the present invention will be described. The reason why the semi-hard magnetic material has a structure composed of martensite and reverse transformed austenite is that the presence of paramagnetic reverse transformed austenite in ferromagnetic martensite prevents a movement of magnetic domain walls in a magnetization process and thus improves the coercive force. The structure composed of martensite and reverse transformed austenite of the present invention refers to a state in which the phases of martensite and austenite are detected when a semi-hard magnetic material is analyzed by X-ray diffraction.

The reason why the amount of reverse transformed austenite of this structure is set to be less than 30.0% is that the coercive force may exceed 5600 A/m when reverse transformed austenite is in a range of not less than 30% and the residual magnetic flux density and the squareness ratio may decrease. A more preferable upper limit of the amount of reverse transformed austenite is 25.0%.

On the other hand, although the lower limit of reverse transformed austenite is not particularly limited, it is preferably more than 0% so as to obtain a coercive force of not less than 1000 A/m, and a more preferable lower limit of the amount of reverse transformed austenite is 5.0%.

Vicker's hardness of the semi-hard magnetic material is set to be not less than 400 Hv as a preferable range, because when the hardness is in this range, it is presumed that an inter metallic compound may be finely precipitated and eventually improve the residual magnetic flux density and the squareness ratio of the semi-hard magnetic material.

Since the intermetallic compound generated in the semi-hard magnetic material of the present invention is extremely fine, it is quite difficult to directly observe it using an optical microscope or an electronic microscope. However, when an intermetallic compound is finely precipitated, hardness is further increased due to precipitation hardening. Therefore, Vicker's hardness can be a indicator for indicating that the intermetallic compound is precipitated.

When Vicker's hardness is not less than 400 Hv, it is possible to presume that the intermetallic compound is finely precipitated and further to adjust $B_r/B_{8000}$ to be not less than 0.70. Therefore, Vicker's hardness is prescribed to be not less than 400 Hv. The intermetallic compound generated in the semi-hard magnetic material of the present invention is considered to be a compound of Ni and Mo, more specifically $Ni_3Mo$.

The semi-hard magnetic material manufactured using the method of the present invention has coercive force Hc adjusted in a range of 1000 to 5600 A/m, improved residual magnetic flux density and a squareness ratio $B_r/B_{8000}$ adjusted to be not less than 0.70, which is a preferable range. Therefore, the semi-hard magnetic material can be used, for example, as a bias material for a crime prevention sensor.

The present invention will be explained in detail using the following examples.

EXAMPLE 1

A semi-hard magnetic material No. 1 was obtained by a vacuum melting using facilities for mass production on an industrial scale, and hot forging at 1100° C. The chemical composition of the material No. 1 is shown in table 1.

[Table 1]

TABLE 1

| No. | C | Si | Mn | P | S | Ni | Mo | [O] | [N] | (mass %) Balance |
|---|---|---|---|---|---|---|---|---|---|---|
| 1 | 0.002 | 0.29 | 0.31 | 0.005 | 0.002 | 20.13 | 4.14 | 12 | 17 | Fe and inevitable impurities |

Note)
Amount of element enclosed by brackets denotes ppm.

A semi-hard magnetic material having the composition of No. 1 was subjected to hot rolling at 1100° C., finished to a thickness of 2.5 mm, further kept in an Ar atmosphere at 830° C. for 1 hour and subjected to air cooling.

The amount of martensite after hot rolling was 98.8% and the amount of martensite after heat treatment was 99.0%. As for the method of measuring the amount of martensite, it was measured based on the above described integration intensity ratio of the X-ray diffraction peaks. Both metallic structures after hot rolling and after heat treatment were martensitic structures into which recrystallized austenitic structures transformed during cooling.

The material after heat treatment was subjected to cold rolling at a reduction of area in a range of 60% to 96% into a plate material.

As an example of the cross-sectional structure of the plate material, FIG. 1 shows observed photograph of a structure of a plate material of a reduction of area of 96% with use of a scanning electron microscopes.

Figure 2:
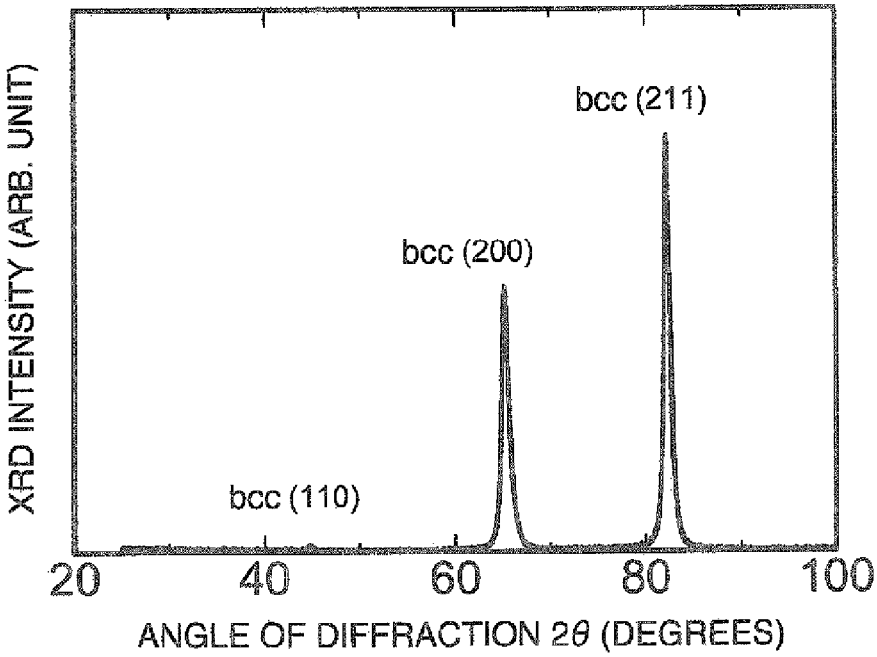
FIG. 2 is an X-ray diffraction pattern of a plate material manufactured by the method of the present invention.

It is seen that an extended anisotropic structure is obtained along the rolling direction. According to the X-ray diffraction pattern of the plate material of a reduction of area of 96%, as shown in FIG. 2, only diffraction peaks of a body-centered cubic lattice were detected, which shows that the structure has 100% of martensitic structure.

The amount of martensite of the plate material subjected to cold rolling at a reduction of area of 60% to 96% was also 100%. As the reduction of area through cold rolling increased, the structure became an extended one in which each crystal grain are made elongated. As a result, this had an influence on the magnetic properties obtained by later heat treatment for generating reverse transformed austenite. This result will be described later.

In this way, it was confirmed that according to the manufacturing method of this example, substantially no reverse transformed austenite was generated in the process until cold rolling was completed.

A strip specimen of 8 mm width×90 mm length and a specimen of 10 mm width×15 mm length were cut out from each plate material which has 100% of extended martensitic structure. The material was heated in an Ar atmosphere furnace at 425 to 650° C. for 1 hour and then air cooled, for generating reverse transformed austenite. Thus, a semi-hard magnetic material was obtained.

The amount of austenite after heat treatment was measured through X-ray diffraction and the hardnesses after cold rolling and after heat treatment were measured using a Vicker's hardness meter under a condition of load of 0.1 kg. Furthermore, DC B—H curves were measured after cold rolling and after heat treatment using a DC magnetic flux meter under a condition of an applied maximum magnetic field being 8000 A/m. The magnetic flux density $B_{8000}$(T) in a magnetic field of 8000 A/m, the residual magnetic flux density $B_r$(T) and the squareness ratio $B_r/B_{8000}$ and the coercive force $H_c$(A/m) were determined from the B—H curve.

Figure 3:
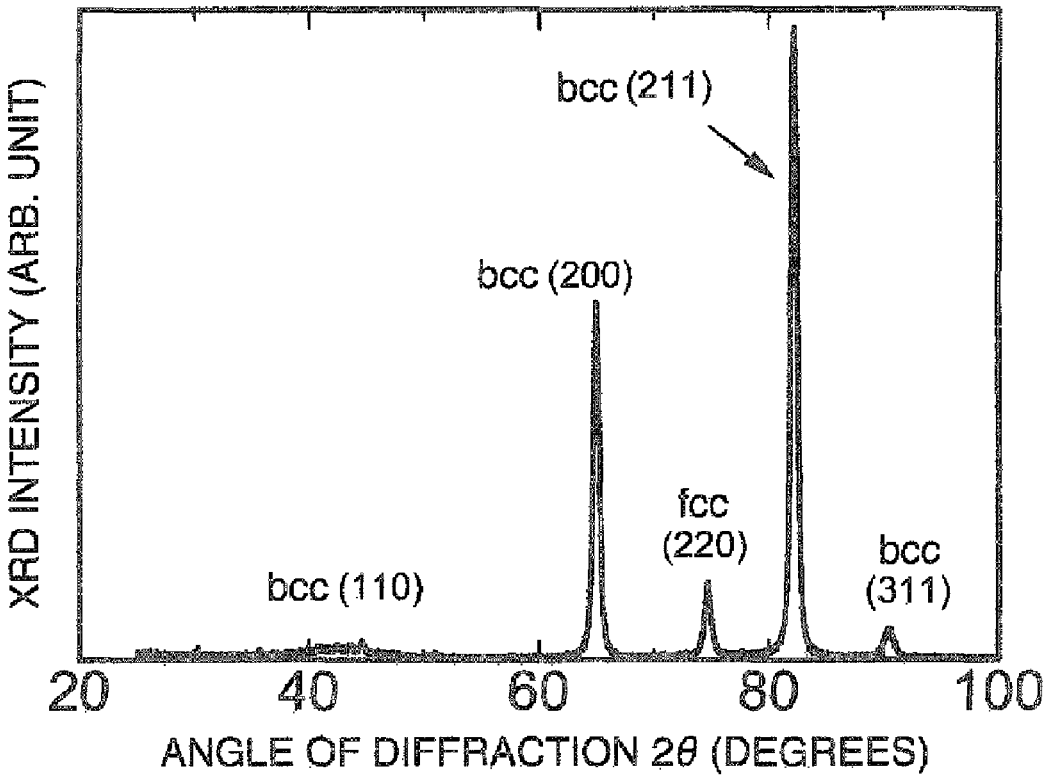
FIG. 3 is an X-ray diffraction pattern of a semi-hard magnetic material of the present invention.

As an example of an X-ray diffraction pattern after heat treatment for generating reverse transformed austenite, FIG. 3 shows an X-ray diffraction pattern of a material subjected to heat treatment, in which a plate material of reduction of area of 96% was heated at 500° C. for 1 hour and then air cooled. It is seen that martensite having body-centered cubic lattice (bcc) and austenite having face-centered cubic lattice (fcc) are detected and that the structure is formed of martensite and reverse transformed austenite.

Figure 4:
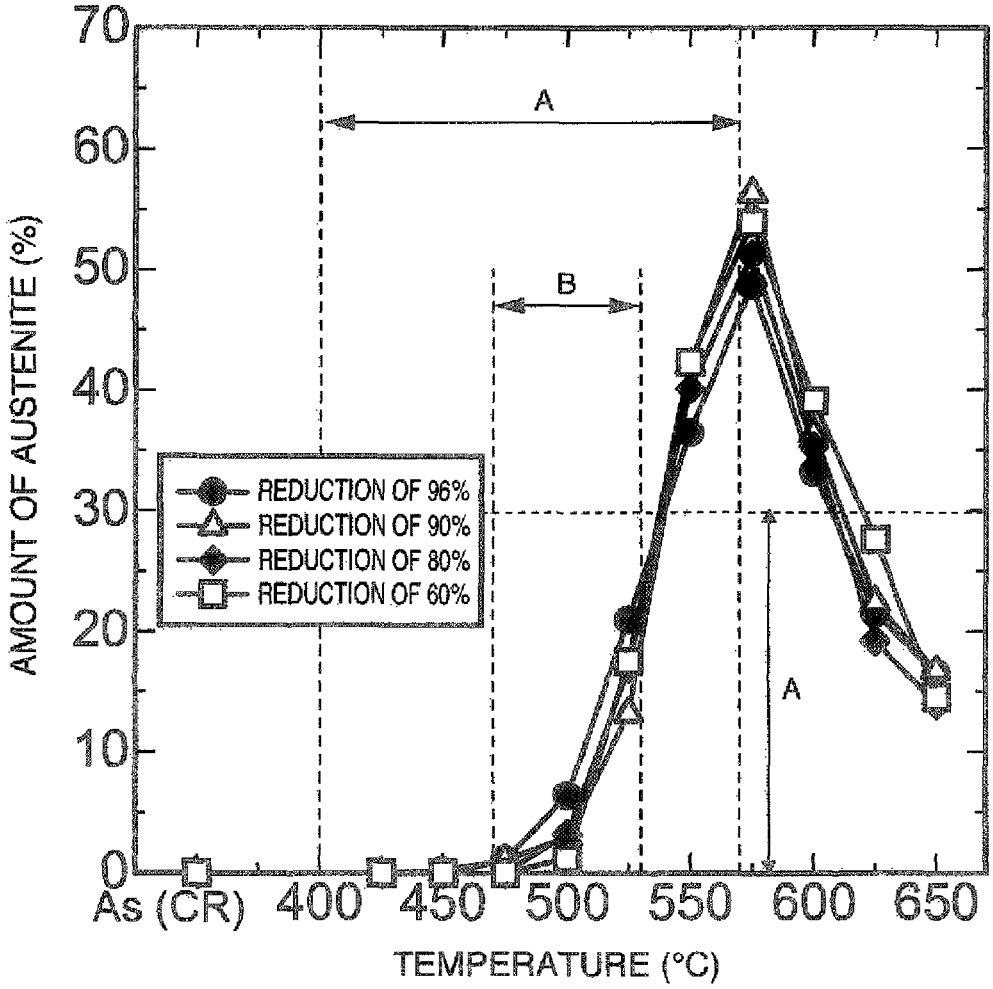
FIG. 4 is a diagram showing an influence of temperatures of heat treatment generating reverse transformed austenite on an amount of austenite.

FIG. 4 shows an influence of temperatures of heat treatment for generating reverse transformed austenite on the amount of austenite of each plate material with various reductions of area by cold rolling (the long double arrow A indicates the range of the present invention and the short double arrow B indicates a preferable range, which is same in FIGS. 5, 6, 7, 13, 14, 15, 16 and 17).

For any plate materials of various reduction of area, the amount of austenite increases as the heat treatment temperature increases as far as the temperature of heat treatment generating austenite is in a range of 400 to 570° C. The amount of austenite becomes at maximum at 575° C. When the temperature exceeds 575° C., the amount of austenite decreases as the temperature increases. This is considered to be due to recrystallization staring at a temperature exceeding 575° C. as to make the austenite generated during heating unstable.

Furthermore, it is seen that the amount of austenite becomes less than 30.0% in a range of 470 to 530° C., which is considered as a more preferable range according to the present invention.

Figure 5:
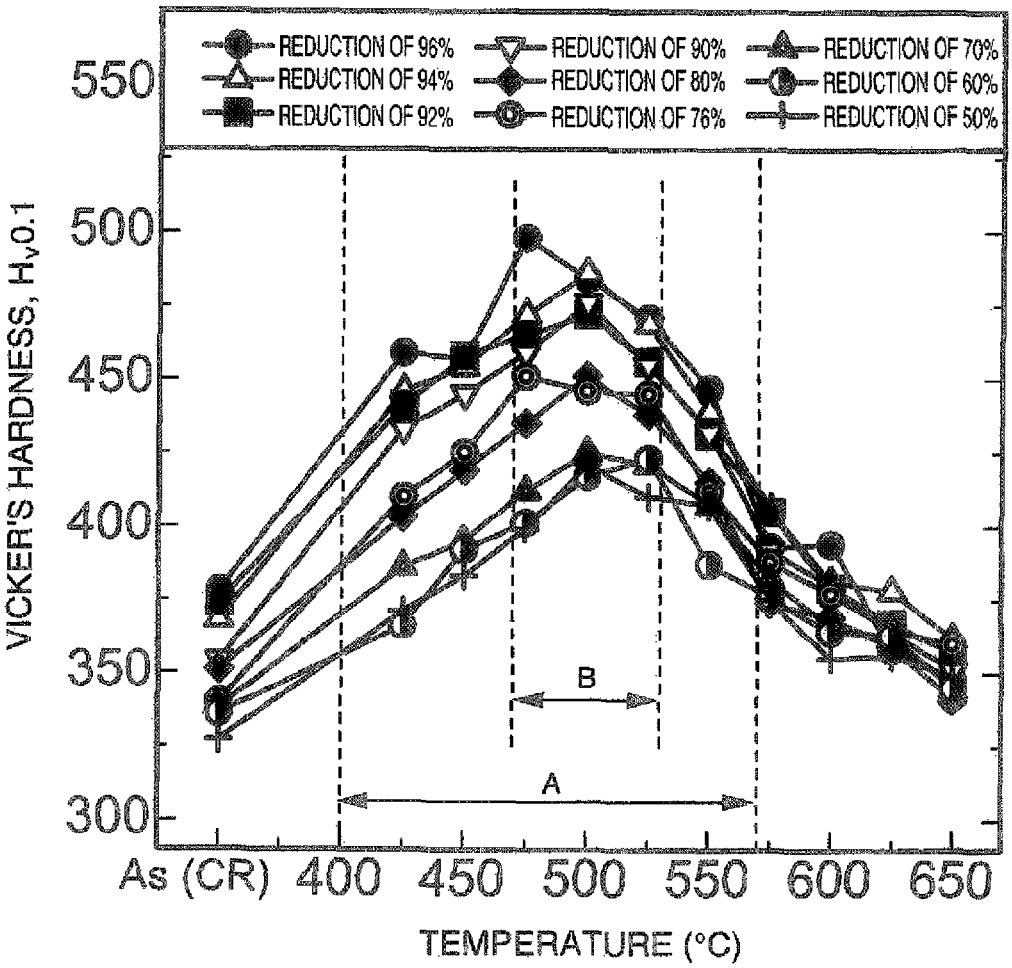
FIG. 5 is a diagram showing an influence of temperatures of heat treatment generating reverse transformed austenite on Vicker's hardness.

On the other hand, FIG. 5 shows an influence of the temperatures of heat treatment for generating reverse transformed austenite on Vicker's hardness of each plate material with various reduction in cold rolling.

For any plate materials of various reductions of area, Vicker's hardness varies showing inverted V-shaped behavior with respect to the temperature of the heat treatment for generating austenite. The hardness subjected to the heat treatment in a range of 400 to 570° C. shows higher hardness than that of the material which is subjected to only cold rolling.

From this, it is seen that an intermetallic compound is precipitated after the heat treatment at 400 to 570° C. Moreover, hardness of not less than 400 Hv is obtained after heat treatment at 470 to 530° C., which is considered as a more preferable range according to the present invention, and that an intermetallic compound is finely precipitated in particular.

Figure 6:
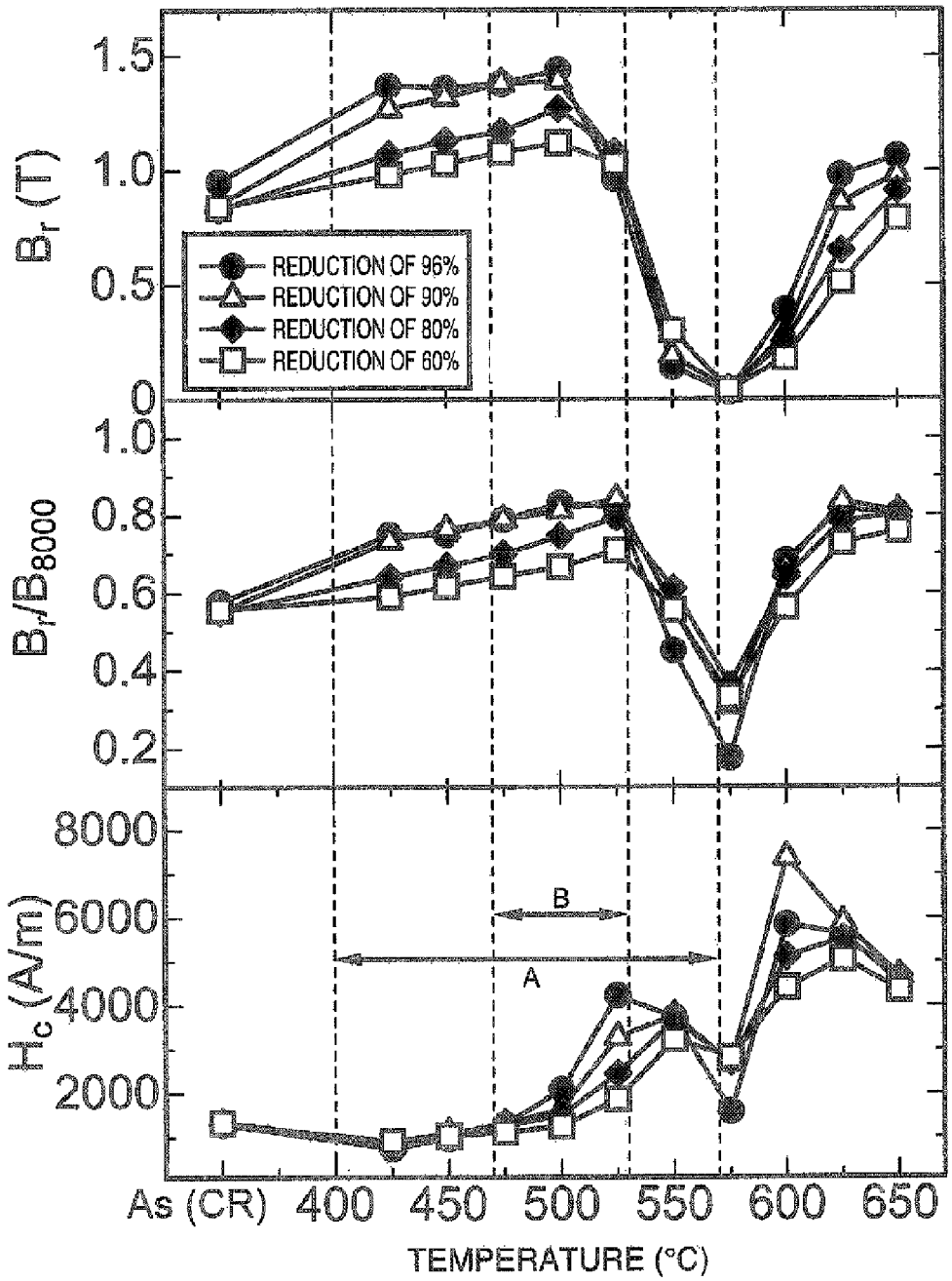
FIG. 6 is a diagram showing an influence of temperatures of heat treatment generating reverse transformed austenite on residual magnetic flux density, squareness ratio and coercive force.

FIG. 6 shows an influence of the heat treatment temperatures on residual magnetic flux density $B_r$(T), squareness ratio $B_r/B_{8000}$ and coercive force $H_c$(A/m) of the material with various reductions of area after heat treatment for generating reverse transformed austenite.

In a range of 425 to 500° C., the residual magnetic flux density $B_r$ after heat treatment shows a higher value than that after cold rolling, while it once drops exceeding 500° C., and increases again at a temperature exceeding 575° C.

The squareness ratio $B_r/B_{8000}$ also shows a tendency similar to that of the residual magnetic flux density $B_r$. It increases as the temperature of heat treatment for generating reverse transformed austenite increases in a range from 425 to 525° C., shows a maximum value at 525° C., while it once drops exceeding 525° C. and increases again exceeding 575° C. Furthermore, the coercive force generally increases as the temperature of heat treatment for generating reverse transformed austenite increases, but it once drops in the vicinity of 575° C. at which the amount of austenite becomes a maximum.

It is seen from FIG. 6 that a semi-hard magnetic material having coercive force of 1000 to 5600 A/m is obtained when heat treatment for generating reverse transformed austenite is performed in a range from 400 to 570° C. prescribed by the present invention. Moreover, it is seen that a high squareness ratio ($B_r/B_{8000}$) of not less than 0.70, which is considered as a more preferable range according to the present invention, is obtained as well, when the heat treatment for generating reverse transformed austenite is performed at 470 to 530° C., which is considered as a more preferable range according to the present invention.

Figure 7:
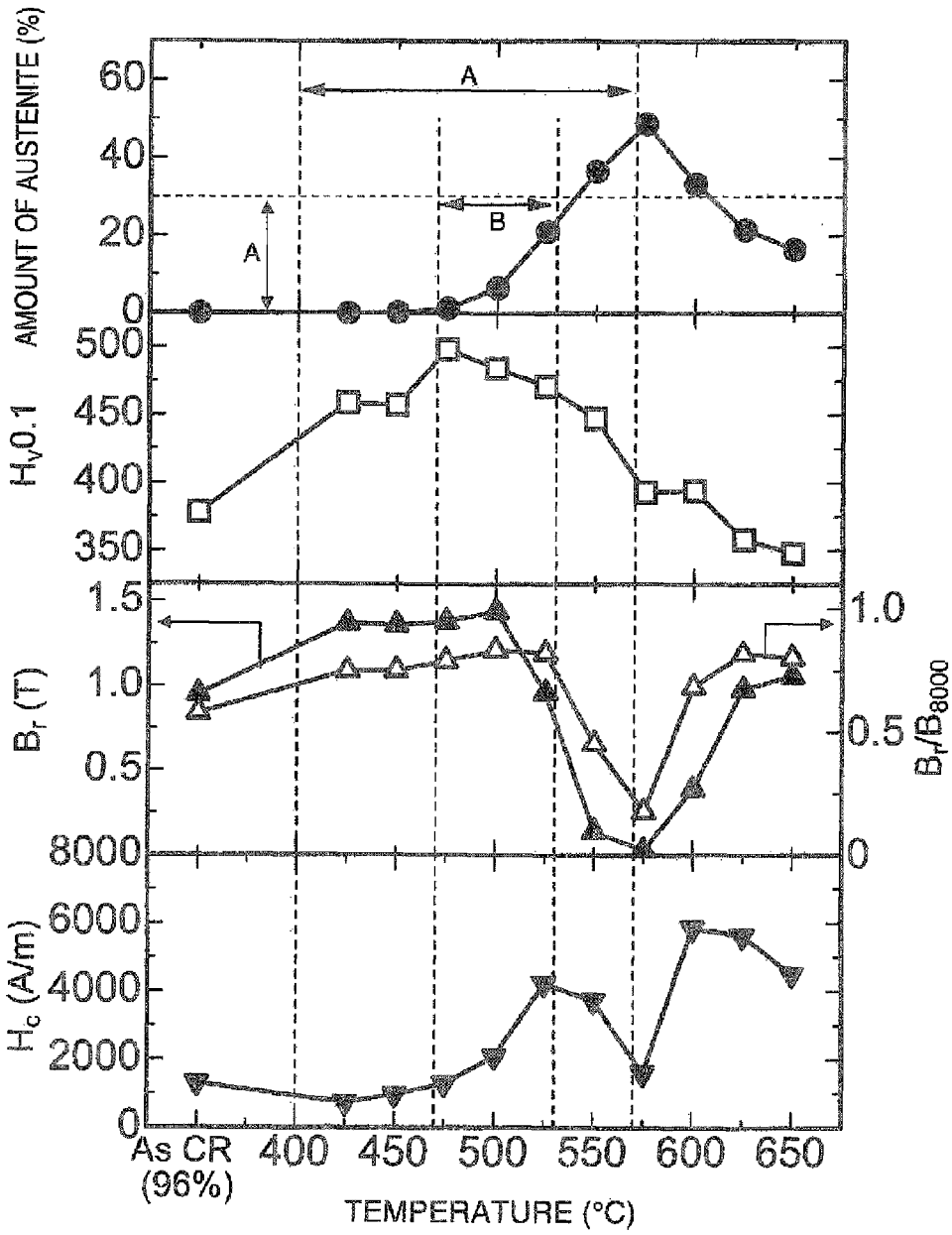
FIG. 7 is a diagram showing an influence of temperatures of heat treatment generating reverse transformed austenite on amount of austenite, Vicker's hardness, residual magnetic flux density, squareness ratio and coercive force.

FIG. 7 shows an influences of a heat treatment temperatures on an amount of reverse transformed austenite (%), Vicker's hardness Hv0.1, residual magnetic flux density $B_r$(T), squareness ratio $B_r/B_{8000}$ and coercive force $H_c$(A/m) together, when heat treatment for generating reverse transformed austenite is applied to the semi-hard magnetic material of a reduction of area of 96%.

It is seen that the behavior of the coercive force Hc with respect to a variation of the heat treatment temperature is quite similar to that of the amount of reverse transformed austenite, and thus the coercive force can be controlled by adjusting the amount of reverse transformed austenite. It is also seen that control of the amount of reverse transformed austenite is also effective in controlling $B_r$ and $B_r/B_{8000}$, since the behaviors of the residual magnetic flux density $B_r$ and the squareness ratio $B_r/B_{8000}$ show an inverted relationship with respect to the amount of reverse transformed austenite at a heat treatment temperature of not less than 500° C.

In a temperature range of the heat treatment lower than 500° C. by which a small amount of reverse transformed austenite is formed, the behaviors of $B_r$ and $B_r/B_{8000}$ are similar to that of Vicker's hardness Hv0.1, and thus $B_r$ and $B_r/B_{8000}$ show a high value in this temperature range of the heat treatment.

From this, it is seen that increasing $B_r$ and $B_r/B_{8000}$ require an intermetallic compound to be finely precipitated. In this way there is a close relationship between the coercive force and the amount of reverse transformed austenitic structure of the semi-hard magnetic material of the present invention, and there is also a close relationship between a higher $B_r$ or $B_r/B_{8000}$ and the precipitation condition of the intermetallic compound.

In FIG. 6, the variation of the magnetic properties with respect to the variation of the temperature of heat treatment for generating reverse transformed austenite shows a similar behavior for any reduction of area. However, the respective characteristic values of Br, $B_r/B_{8000}$ and Hc vary depending on the reduction of area, which suggests that the magnetic characteristics have dependency on the reduction of area.

Figure 8:
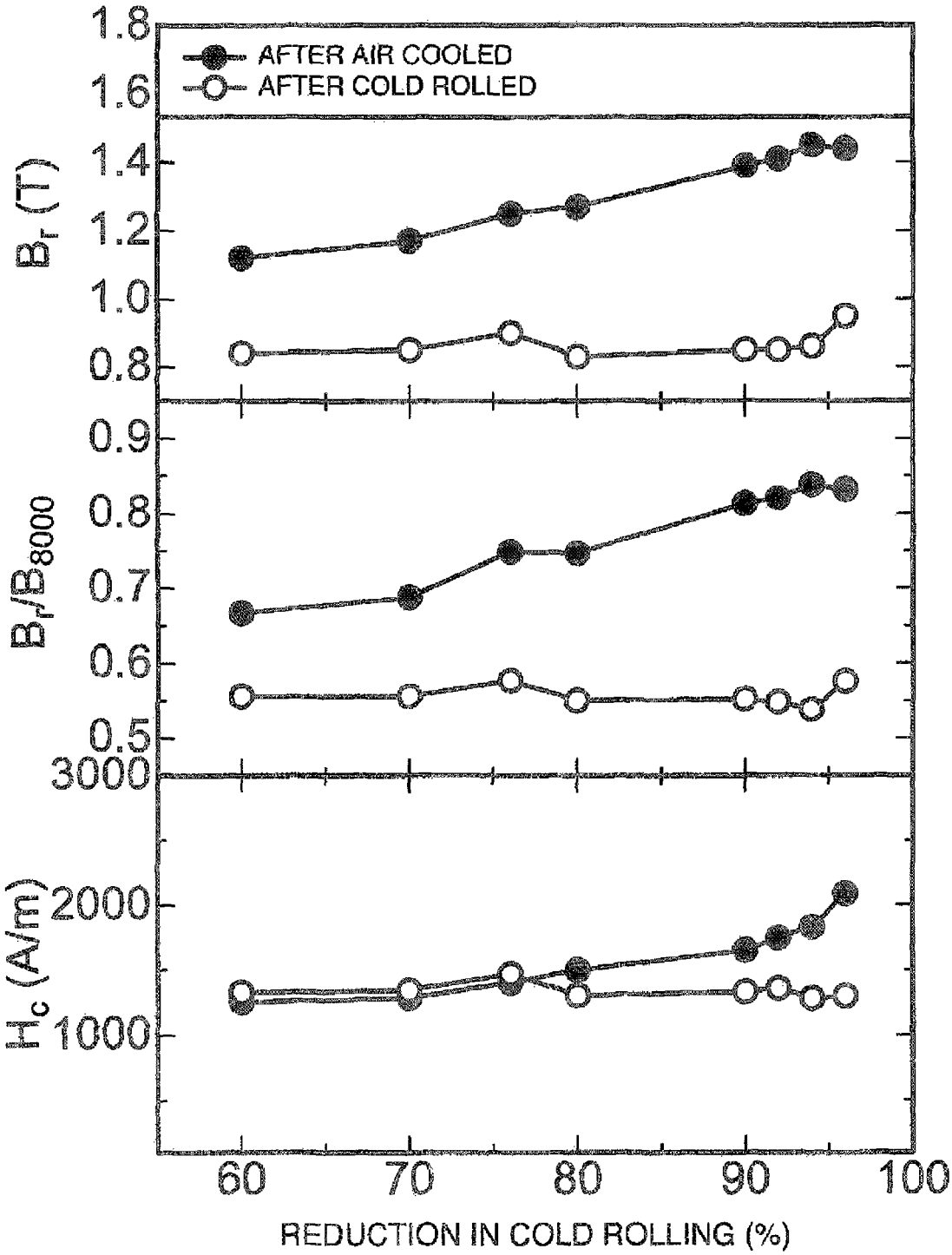
FIG. 8 is a diagram showing an influence of reduction in cold rolling on residual magnetic flux density, squareness ratio and coercive force.

FIG. 8 shows an influence of the reduction of area on the respective characteristic values of Br, $B_r/B_{8000}$ and Hc in a case where the heat treatment is applied in which the material is heated at 500° C. for 1 hour and air cooled after cold rolling and in a case where it is subjected to only cold rolling. When it is subjected to only cold rolling (which is indicated by a white circle in the figure), the variations of the respective characteristic values do not vary remarkably even if the reduction of area changes. The respective characteristic values of Br, $B_r/B_{8000}$ and Hc increase as the reduction of area increases after the heat treatment at 500° C. (which is indicated by a black circular in the figure).

Furthermore, it is seen that the respective characteristic values increase remarkably when a reduction of area is not less than 90%. From this, it is seen that it is possible to obtain a coercive force Hc of 1000 to 5600 A/m and a high squareness ratio $B_r/B_{8000}$ of not less than 0.70, which is a preferable range, by increasing the reduction of area of the cold rolling, and it brings about good results of the magnetic characteristics of the semi-hard magnetic material.

Figure 9:
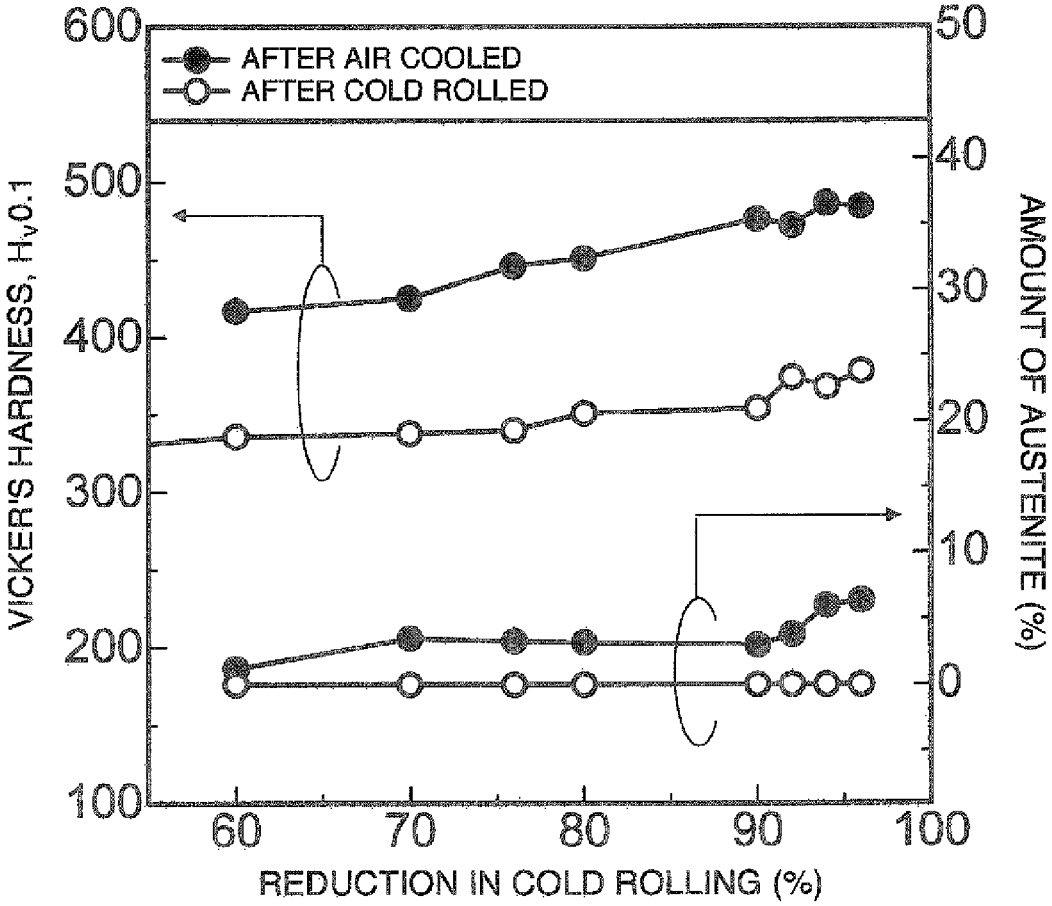
FIG. 9 is a diagram showing an influence of a reduction in cold rolling on amount of austenite and Vicker's hardness.

In order to explain the result in FIG. 8 from an view of a material structure, FIG. 9 shows an influence of the reduction of area on Vicker's hardness Hv0.1 and the amount of reverse transformed austenite (%) in a case where heat treatment is applied in which the material is heated at 500° C. for 1 hour and air cooled after cold rolling and in a case where it is subjected to only cold rolling.

The hardness increases along with the increase of the reduction of area in any conditions of after heat treatment for generating reverse transformed austenite and after cold rolling. In the case of the reduction of area of 60%, however, the difference in hardness between after cold rolling (336 Hv) and after heat treatment (417 Hv) is 81 Hv, while in the case of reduction of area of 96%, the difference in hardness between after cold rolling (378 Hv) and after heat treatment (484 Hv) expands to 106 Hv.

The amount of austenite after cold rolling is 0% for any reduction of area, as described above. However, the amount of the reverse transformed austenite generated after heat treatment is 1.2% when the reduction of area is 60%, and 6.3% when the reduction of area is 96%. This shows that amount of austenite increases along with the reduction of area.

In this way, the hardness and the amount of reverse transformed austenite after heat treatment for generating reverse transformed austenite have a dependency on a reduction of area. It is considered to be because precipitation sites of an intermetallic compound by aging and the driving force for reverse transformation from martensite to austenite increase as the reduction of area increases. It is considered that the increase of precipitation site of an intermetallic compound by aging and the driving force of reverse transformation from martensite to austenite is a factor of a variation of the magnetic properties with respect to a variation of the reduction of area shown in FIG. 8.

EXAMPLE 2

Based on the result of Example 1, an industrial prototype of a semi-hard magnetic material was manufactured in the following manufacturing processes.

A raw material for a semi-hard magnetic material was obtained through a vacuum melting using mass production facilities on an industrial scale, and hot forging at 1100° C. After hot rolling on the material at 1100° C. to a thickness of 2.5 mm, the material was subjected to heat treatment in a vacuum furnace. The chemical composition of this semi-hard magnetic material is the same as that shown in Table 1.

As the heat treatment condition, the material was heated at 830° C., and kept for one hour, and then rapidly cooled by $N_2$ gas. The amount of martensite after hot working was 98.9% and that after heat treatment was 99.0%. The amount of martensite was measured based on the above described X-ray diffraction integration intensity ratios. Both metallic structures after hot rolling and after heat treatment were recrystallized structures.

The heat-treated plate material was subjected to cold rolling at a reduction of area of 60% to a thickness of 1 mm, and then passed through a furnace adjusted so that the temperature of the plate material became approximately 900° C. as an intermediate heat treatment (continuous furnace heat treatment). Thus the plate material was softened. The plate material after the intermediate heat treatment was subjected to cold rolling (hereinafter, described as "final cold rolling") at a reduction of area of 95% and a plate material having a thickness of 0.05 mm was obtained.

X-ray diffraction patterns of the plate material after the intermediate heat treatment and after the final cold rolling were examined, and it is shown that both patterns have 100% of martensitic structure.

Therefore, in the manufacturing process in the example 2, reverse transformed austenite was not generated in the middle of the process. The structures after the intermediate heat treatment and after the final cold rolling was observed, and it was confirmed that the structure after the intermediate heat treatment became recrystallized structure, while it became an extended structure through subsequent final cold rolling at a rolling reduction of 95%.

Specimens similar to those in Example 1 were cut out from this plate material having a thickness of 0.05 mm, and then subjected to heat treatment for generating reverse transformed austenite, in which it is heated in a small experimental furnace for one hour in an Ar atmosphere at 475 to 525° C. A semi-hard magnetic material was thereby prepared and then the amount of austenite and a magnetic properties were measured. Furthermore, the plate material having a thickness of 0.05 mm was wound in a coil and inserted into a large mass production furnace, in order to perform to the heat treatment for generating reverse transformed austenite, in which it was heated at 508° C. for one hour in an Ar atmosphere. A semi-hard magnetic material was thereby prepared and then the amount of austenite and the magnetic properties were measured.

Figure 10:
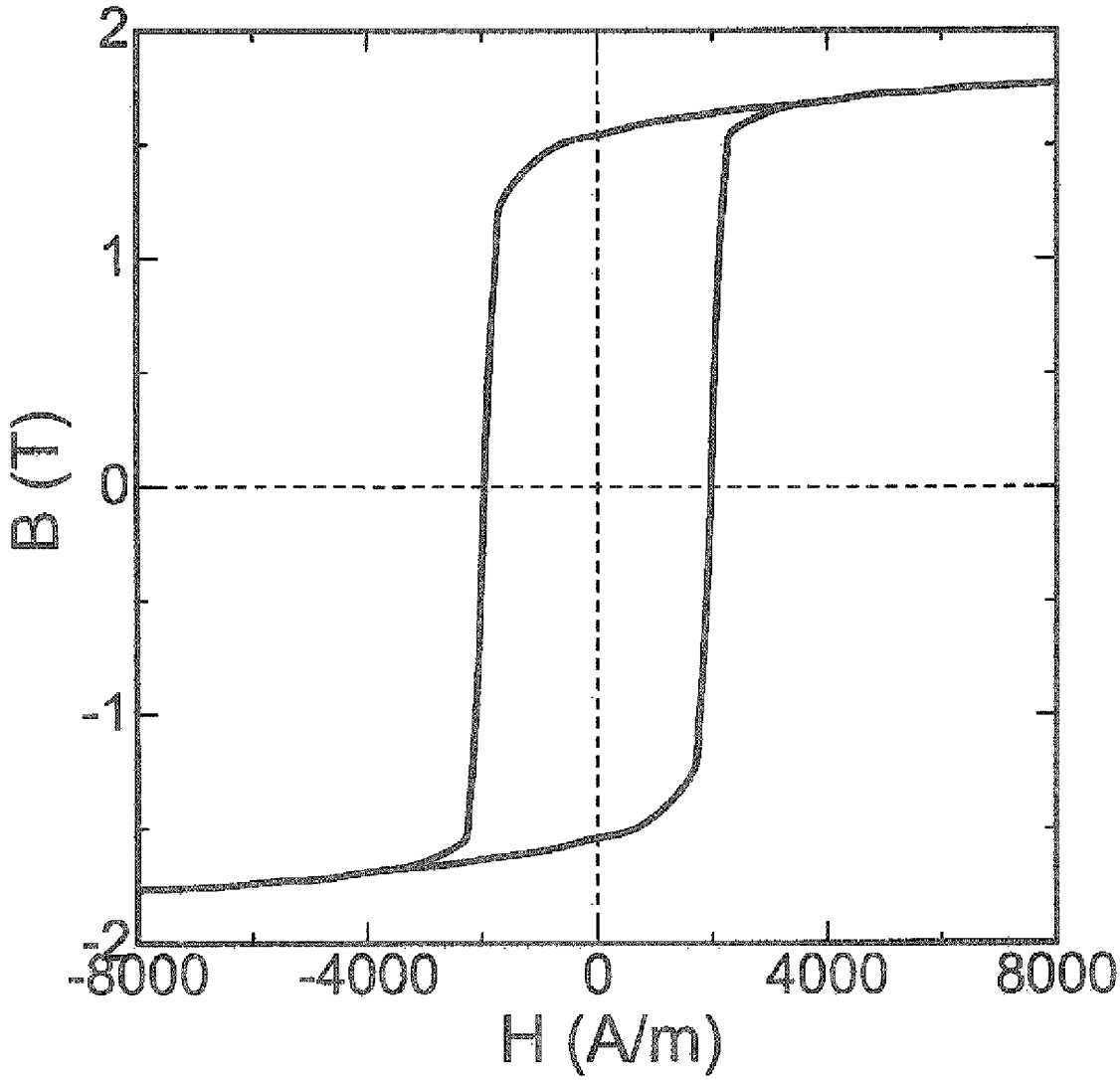
FIG. 10 is a B—H curve of a semi-hard magnetic material of the present invention.

Table 2 shows a list of temperatures of heat treatment for generating reverse transformed austenite, an amount of austenite (%), magnetic flux density $B_{8000}$(T), residual magnetic flux density $B_r$(T), squareness ratio $Br/B_{8000}$ and coercive force $H_c$(A/m). Furthermore, FIG. 10 shows a B—H curve after one-hour heat treatment at 508° C. in a large mass production heat treatment furnace as an example of a B—H curve of the semi-hard magnetic material.

[Table 2]

TABLE 2

| Heat treatment temperature (° C.) | Amount of austenite (%) | Vicker's hardness Hv0.1 | Magnetic flux density $B_{8000}$(T) | Residual magnetic flux density $B_r$(T) | Squareness ratio $Br/B_{8000}$ | Coercive force $H_c$(A/m) | Remarks |
|---|---|---|---|---|---|---|---|
| 475 (Experimental furnace) | 2.1 | 485 | 1.92 | 1.53 | 0.797 | 1432 | Present invention |
| 480 (Experimental furnace) | 4.2 | 489 | 1.91 | 1.53 | 0.801 | 1496 | |
| 490 (Experimental furnace) | 6.2 | 475 | 1.86 | 1.51 | 0.812 | 1914 | |
| 500 (Experimental furnace) | 10.3 | 488 | 1.82 | 1.48 | 0.813 | 2292 | |
| 510 (Experimental furnace) | 17.2 | 485 | 1.72 | 1.41 | 0.820 | 3219 | |
| 520 (Experimental furnace) | 29.2 | 487 | 1.45 | 1.16 | 0.800 | 5021 | |
| 508 (Mass production furnace) | 3.3 | 491 | 1.77 | 1.54 | 0.870 | 1958 | |

Note)

The words "heat treatment temperature" refer to "temperature of heat treatment for generating reverse transformed austenite".

It is seen from Table 2 that the semi-hard magnetic material prepared using the manufacturing method of the present invention has amount of austenitic structure in a range of less than 1.0 to 30.0% which is a preferable ranger and coercive force in a range of 1000 to 5600 A/m. Vicker's hardness of not less than 400 Hv, which is also a preferable range, high residual magnetic flux density of not less than 1.16 T and high squareness ratio of not less than 0.797 are obtained.

It is also seen from the B—H curve shown in FIG. 10 that the semi-hard magnetic material of the present invention has a high squareness ratio.

EXAMPLE 3

Based on the result of Example 1, an industrial prototype of a semi-hard magnetic material was manufactured in the following manufacturing processes.

A raw material for a semi-hard magnetic material was obtained through a vacuum melting using mass production facilities on an industrial scale, and hot forging at 1100° C. This raw material was subjected to hot rolling at 1100° C. to a thickness of 2.5 mm. The chemical composition of the semi-hard magnetic material is the same as that shown in Table 1.

Next, the material was directly subjected to cold rolling at a reduction of 98% without heat treatment to reduce processes, and a plate material having a thickness of 0.05 mm was obtained. It was confirmed that this plate material also had 100% of martensitic structure and an extended structure.

Specimens were cut out from the plate material as in the cases of Examples 1 and 2. They were then subjected to heat treatment for generating reverse transformed austenite in a range of 475 to 525° C. and measured.

Table 3 shows a list of temperatures of heat treatment for generating reverse transformed austenite, amount of austenite (%), magnetic flux density $B_{8000}$(T). residual magnetic flux density $B_r$(T), squareness ratio $Br/B_{8000}$ and coercive force $H_c$(A/m).

[Table 3]

TABLE 3

| Heat treatment temperature (° C.) | Amount of austenite (%) | Magnetic flux density $B_{8000}$(T) | Residual magnetic flux density $B_r$(T) | Squareness ratio $Br/B_{8000}$ | Coercive force $H_c$(A/m) | Remarks |
|---|---|---|---|---|---|---|
| 475 | 1.2 | 1.78 | 1.38 | 0.775 | 1036 | Present |
| 500 | 2.5 | 1.74 | 1.41 | 0.810 | 1261 | invention |
| 510 | 4.0 | 1.80 | 1.47 | 0.817 | 1405 | |
| 515 | 6.2 | 1.75 | 1.46 | 0.834 | 1480 | |
| 520 | 10.3 | 1.69 | 1.44 | 0.852 | 1802 | |
| 525 | 15.6 | 1.64 | 1.44 | 0.878 | 2399 | |

Note)
The words "heat treatment temperature" refer to "temperature of heat treatment for generating reverse transformed austenite".

It is seen from Table 3 that an amount of austenite in a range of less than 1.0 to 30.0%, which is a preferable range, and coercive force in a range of 1000 to 5600 A/m are obtained by the manufacturing method of Example 3. Moreover, high residual magnetic flux density of not less than 1.38 T and high squareness ratio of not less than 0.775 are obtained.

It is seen that, as for the semi-hard magnetic material prepared using the manufacturing method in Examples 1 to 3, it is possible to obtain a semi-hard magnetic material having desired magnetic properties by adjusting the amount of austenite in the heat treatment process generating reverse transformed austenite without including a process of intentionally generating reverse transformed austenite in the middle of a manufacturing process or a process of controlling the shape of reverse transformed austenite through cold rolling after heat treatment for generating reverse transformed austenite.

That is, it has been proved in Examples 1 to 3 that the manufacturing process of a semi-hard magnetic material can be simplified.

EXAMPLE 4

Specimens were cut out from the semi-hard magnetic material of a reduction of area of 95% of the final cold rolling and having a thickness of 0.05 mm prepared in Example 2. An experiment was conducted to examine an influence of the holding time of the heat treatment for generating reverse transformed austenite.

Figure 11:
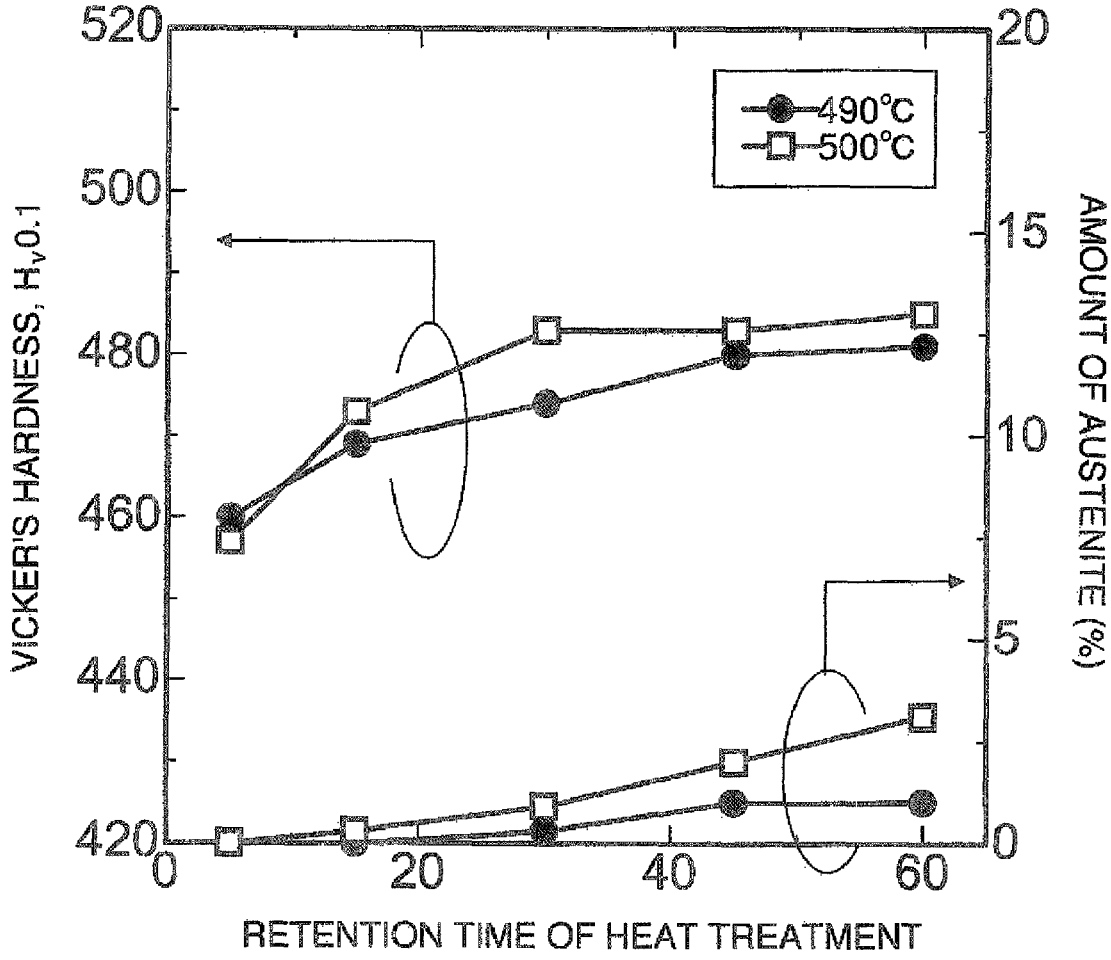
FIG. 11 is a diagram showing an influence of a holding time during heat treatment generating reverse transformed austenite on amount of austenite and Vicker's hardness.

FIG. 11 shows changes in Vicker's hardness and the amount of austenite when the temperature of heat treatment for generating reverse transformed austenite is fixed to 490° C. or 500° C. and the holding time is changed in a range of 5 to 60 minutes.

Figure 12:
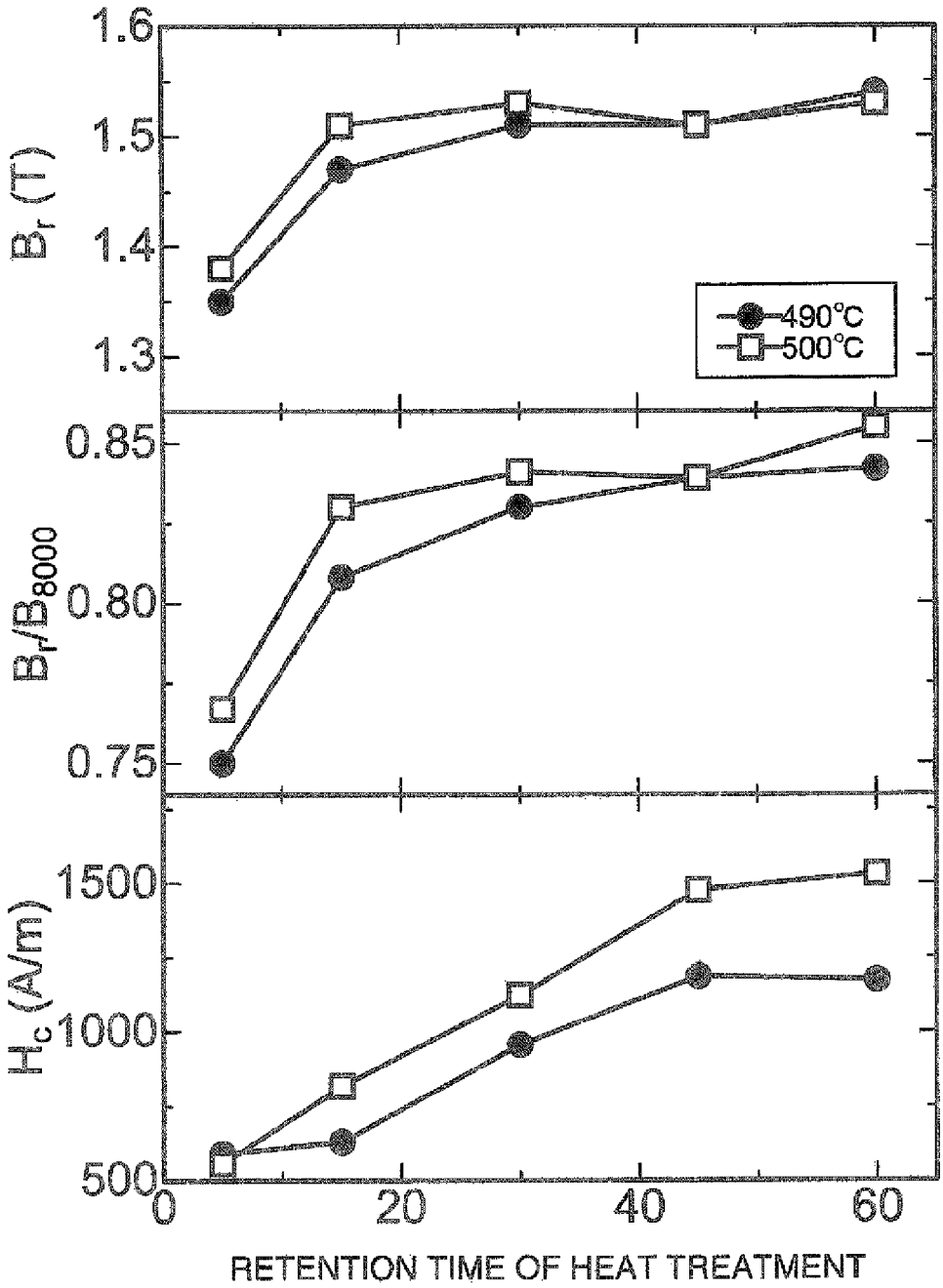
FIG. 12 is a diagram showing an influence of holding time during heat treatment generating reverse transformed austenite on residual magnetic flux density, squareness ratio and coercive force.

Whether temperatures of the heat treatment were 490 or 500° C., Vicker's hardness and the amount of austenite increase as the holding time increases. Furthermore, FIG. 12 shows changes of the magnetic properties as the holding time increases.

$B_r$, $B_r/B_{8000}$ and $H_c$ increase as the holding time increases. Especially, Br and $B_r/B_{8000}$ show high values when the holding time is not less than 10 minutes, which is considered to be a preferable range according to the manufacturing method of the present invention. It is also seen that He becomes not less than 1000 A/m when the holding time is not less than 30 minutes, which is considered to be a more preferable range. In this way, since holding time of not less than 10 minutes is preferable, more preferable not less than 30 minutes, for the heat treatment for generating reverse transformed austenite which becomes the final process, a batch furnace is suitable for the heat treatment.

EXAMPLE 5

The amount of austenite, hardness and magnetic properties are examined with semi-hard magnetic materials having compositions in the neighborhood of that of Table 1. 11 types of raw materials for a semi-hard magnetic material were prepared, which are changed with amounts of Ni and Mo, each having a weight of 10 kg, by vacuum melting. Nos. 2 to 12 in Table 4 respectively show chemical compositions of the prepared raw materials.

All of them have compositions in the range of the present invention. These materials were heated at 1100° C. They were subjected to hot forging, and hot forged materials of approximately 20 mm×60 mm×600 mm were obtained. Each forged material was then heated at 1100° C., and subjected to hot rolling. Thus, hot rolled materials having a thickness of 2.5 mm were obtained. After removing oxide scales from the hot rolled materials, the materials were heated at 830° C. for one hour in an Ar atmosphere and then subjected to air cooling. Then, the materials were subjected to cold rolling at a reduction of area of 96% and plate materials for the semi-hard magnetic material having a thickness of 0.1 mm were obtained.

[Table 4]

TABLE 4

| No. | C | Si | Mn | P | S | Ni | Mo | [O] | [N] | (mass %) Balance |
|---|---|---|---|---|---|---|---|---|---|---|
| 2 | 0.073 | 0.29 | 0.30 | 0.004 | 0.001 | 12.52 | 4.04 | 51 | 7 | Fe and inevitable impurities |
| 3 | 0.003 | 0.30 | 0.30 | 0.003 | 0.002 | 15.12 | 2.03 | 31 | 6 | Fe and inevitable impurities |
| 4 | 0.002 | 0.29 | 0.30 | 0.001 | 0.002 | 15.16 | 3.02 | 24 | 5 | Fe and inevitable impurities |
| 5 | 0.003 | 0.31 | 0.30 | 0.001 | 0.002 | 15.14 | 4.02 | 15 | 6 | Fe and inevitable impurities |
| 6 | 0.003 | 0.31 | 0.30 | 0.001 | 0.002 | 15.17 | 5.02 | 14 | 5 | Fe and inevitable impurities |
| 7 | 0.003 | 0.31 | 0.30 | 0.001 | 0.002 | 15.15 | 5.95 | 13 | 5 | Fe and inevitable impurities |
| 8 | 0.007 | 0.29 | 0.29 | 0.002 | 0.001 | 17.49 | 4.05 | 59 | 7 | Fe and inevitable impurities |
| 9 | 0.002 | 0.31 | 0.30 | 0.003 | 0.001 | 20.02 | 2.10 | 47 | 6 | Fe and inevitable impurities |
| 10 | 0.001 | 0.31 | 0.30 | 0.002 | 0.002 | 20.18 | 3.07 | 33 | 6 | Fe and inevitable impurities |
| 11 | 0.001 | 0.30 | 0.30 | 0.001 | 0.001 | 20.19 | 4.08 | 28 | 5 | Fe and inevitable impurities |
| 12 | 0.002 | 0.30 | 0.30 | 0.002 | 0.002 | 20.15 | 5.08 | 23 | 5 | Fe and inevitable impurities |

Note)
Amount of element in brackets denotes ppm

As in the case of Example 1, strip specimens of 8 mm width×90 mm length were cut out from each raw material for the semi-hard magnetic material. They were heated at 425 to 650° C. for 1 hour in an Ar atmosphere furnace and then subjected to air cooling, as heat treatment for generating reverse transformed austenite. This heat treatment caused each raw material become a semi-hard magnetic material.

Figure 13:
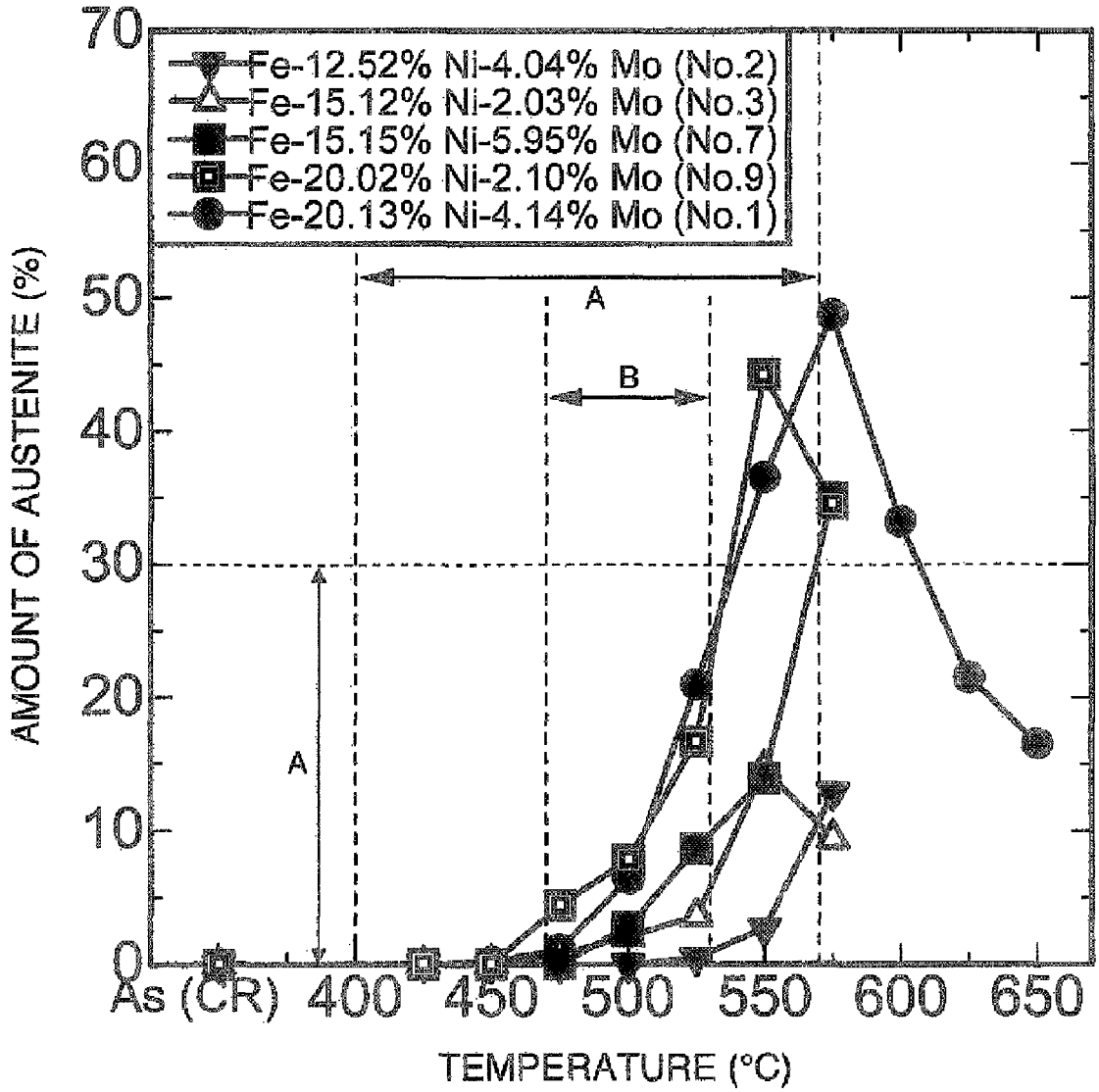
FIG. 13 is a diagram showing an influence of temperatures of heat treatment generating reverse transformed austenite on an amount of austenite.

Direct current B—H curves after cold rolling and after heat treatment were measured using a DC magnetic flux meter under conditions of an applied maximum magnetic field being 8000 A/m. Based on these B—H curves, magnetic flux density $B_{8000}$(T) in a magnetic field of 8000 A/m, residual magnetic flux density $B_r$(T), squareness ratio $B_r/B_{8000}$ and coercive force $H_c$(A/m) were determined. Furthermore, specimens of approximately 8 mm width×15 mm length were cut out from some specimens after measurement of magnetic properties and subjected to measurement of the amount of austenite through X-ray diffraction and Vicker's hardness FIG. 13 shows an influence of heat treatment temperatures on the amount of austenite when the heat treatment for generating reverse transformed austenite was applied to raw materials Nos. 2, 3, 7, 9 and the raw material No. 1 in Table 1.

The amount of austenite increases in Nos. 2, 3, 7, 9 as the heat treatment temperature increases as in the case of No. 1. Nos. 3 and 9 show the maximum amount of austenite at 550° C. It is seen that the amount of generated austenite varies depending on the chemical composition. Austenitic structure is generated in all raw materials after heat treatment at any temperature of 400 to 570° C. It is seen that the amount of austenite is below 30.0% after heat treatment at 470 to 530° C., which is considered as a more preferable range according to the present invention.

Figure 14:
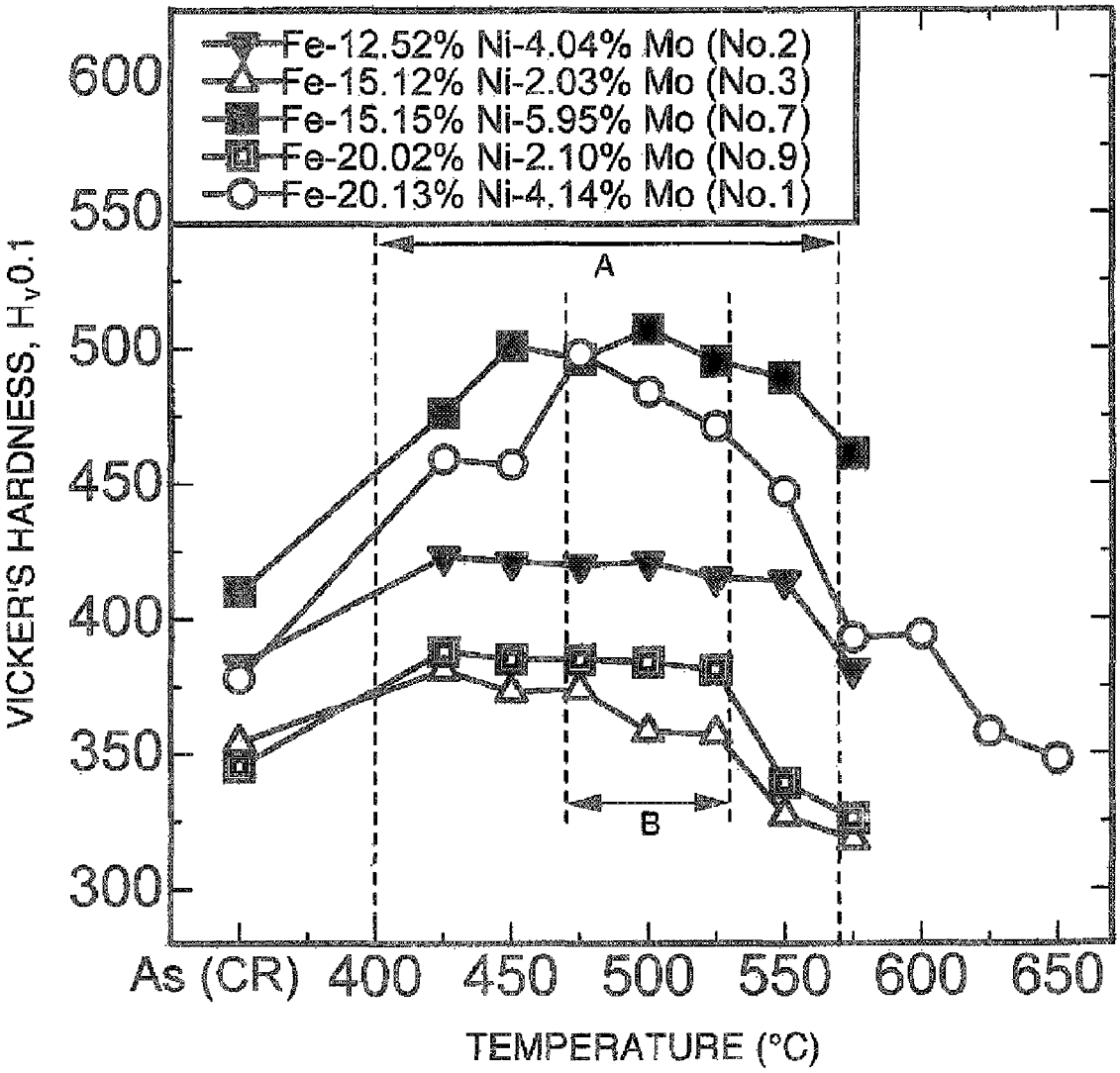
FIG. 14 is a diagram showing an influence of temperatures of heat treatment generating reverse transformed austenite on Vicker's hardness.

Furthermore, FIG. 14 shows an influence of heat treatment temperatures on hardness when the heat treatment for generating reverse transformed austenite was applied to raw materials Nos. 2, 3, 7, 9 and No. 1 in Table 1.

It is seen that all raw materials show higher hardness after the heat treatment at any temperature of 400 to 570° C. than that subjected only to cold rolling. A hardening occurs due to fine precipitation of an intermetallic compound. Especially, high hardness of not lower than 400 Hv, which is considered to be preferable in the present invention, is obtained in Nos. 1, 2, 7, in which the amount of Mo is set to 4.14%, 4.04% and 5.95% respectively.

Figure 15:
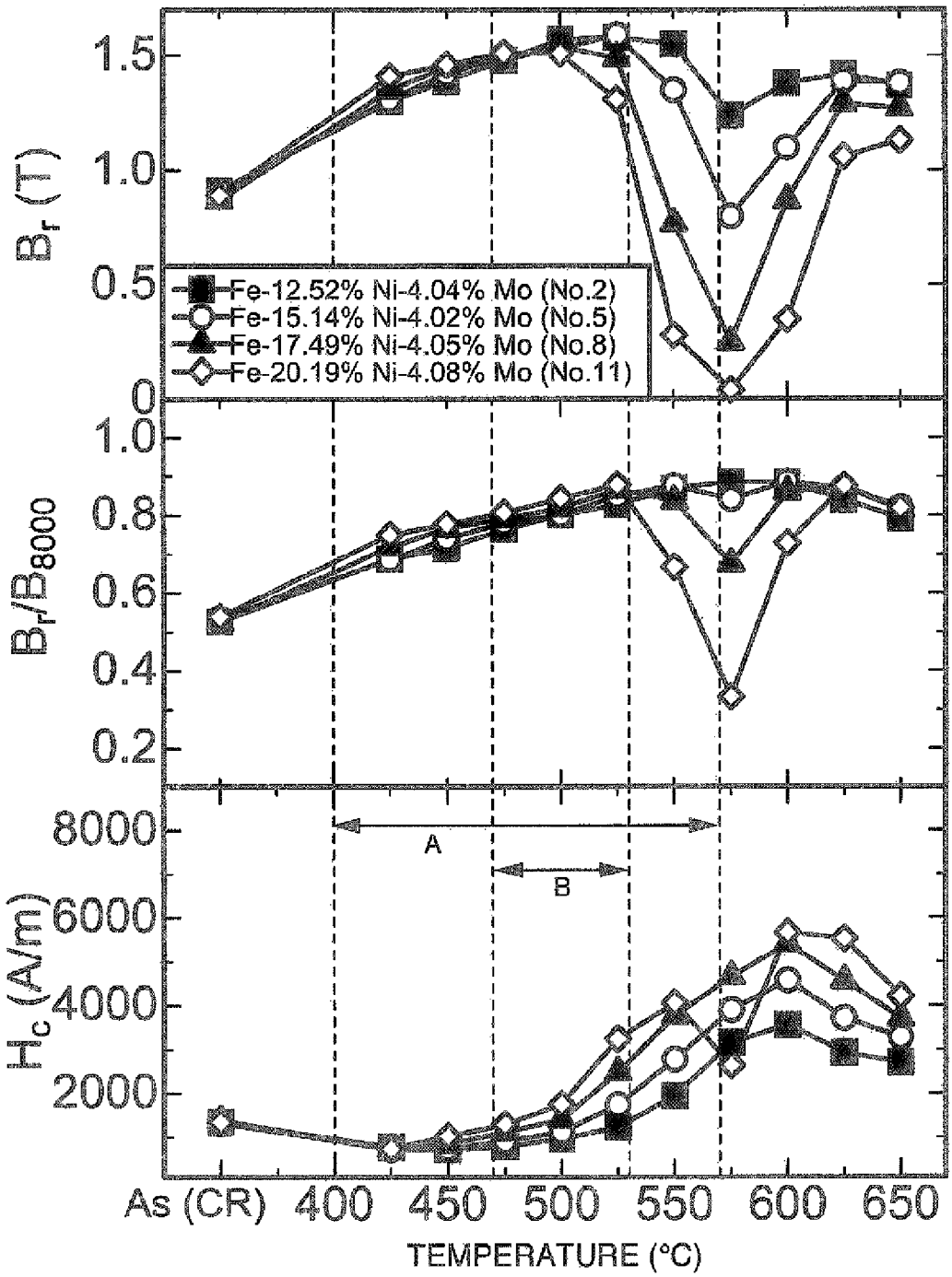
FIG. 15 is a diagram showing an influence of temperatures of heat treatment generating reverse transformed austenite on residual magnetic flux density, squareness ratio and coercive force.
Figure 16:
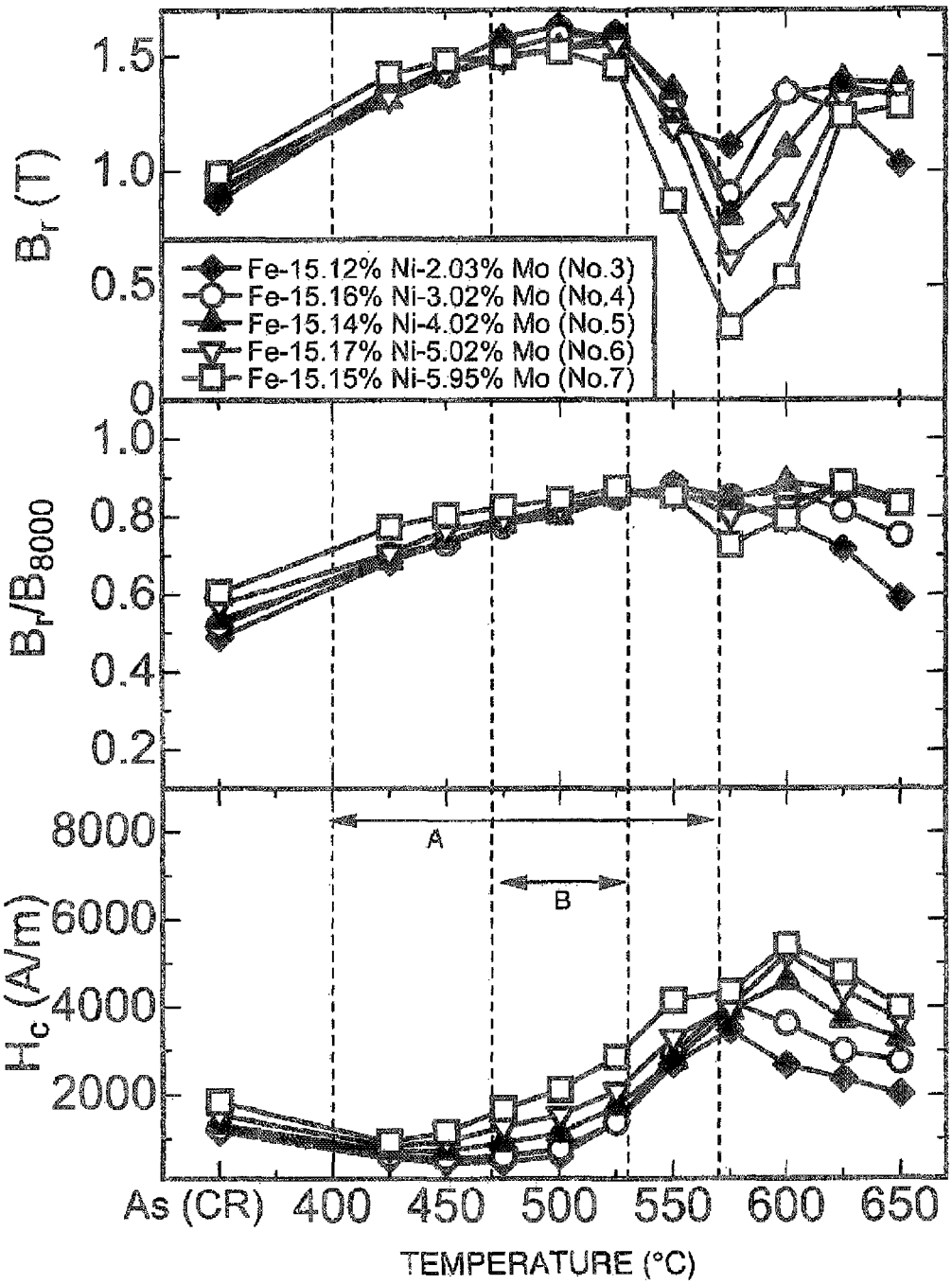
FIG. 16 is a diagram showing an influence of temperatures of heat treatment generating reverse transformed austenite on residual magnetic flux density, squareness ratio and coercive force.
Figure 17:
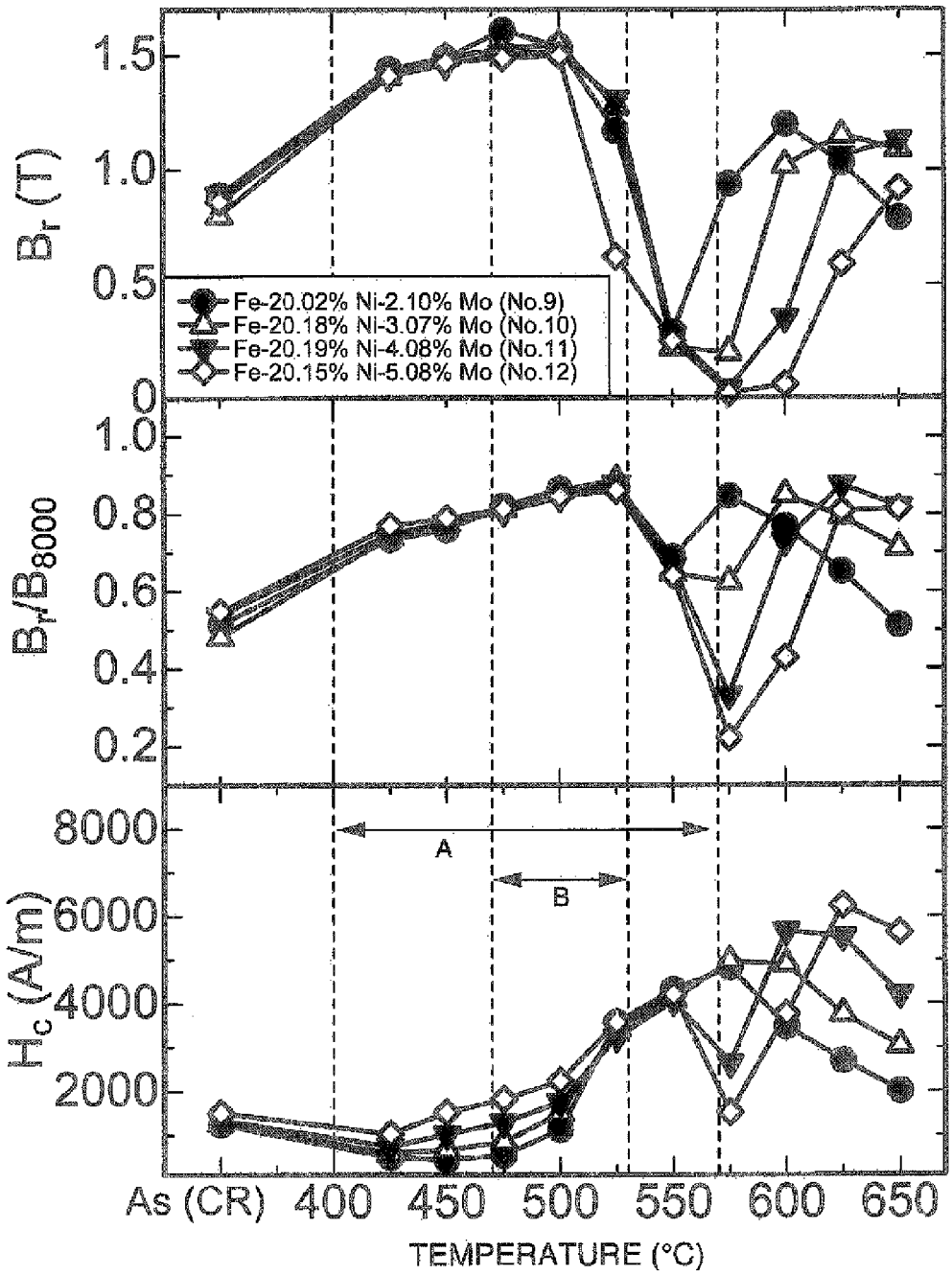
FIG. 17 is a diagram showing an influence of temperatures of heat treatment generating reverse transformed austenite on residual magnetic flux density, squareness ratio and coercive force.

Next, FIGS. 15 to 17 show an influence of the heat treatment temperatures on the magnetic properties ($B_r$, $B_r/B_{8000}$, $H_c$) when the heat treatment for generating reverse transformed austenite is applied to raw materials for the semi-hard magnetic material Nos. 2 to 12.

FIG. 15 shows an influence of the heat treatment temperatures on magnetic properties of raw materials Nos. 2, 5, 8, 11 with the amount of Mo fixed to 4% and the amount of Ni changed in a range of 12.52 to 20.19%.

Br and $B_r/B_{8000}$ increase as the temperature rises, then decrease once in a range of 500 to 575° C. and then increase again. Furthermore, Hc tends to generally increase as the heat treatment temperature rises. The respective characteristic values of $B_r$, $B_r/B_{8000}$, $H_c$ vary depending on the amount of Ni, and this is believed to be due to the difference in stability of reverse transformed austenite. That is, the higher the amount of Ni of a raw material, the more stable austenite generated by reverse transformation from martensite. Therefore, it seems that $B_r$ and $B_r/B_{8000}$ decrease, while Hc increases since a large amount of austenite remains at room temperature.

When attention is focused on the relationship between the heat treatment temperature and the magnetic characteristics, a coercive force of 1000 to 5600 A/m and $B_r/B_{8000}$ of not less than 0.70, which are considered as preferable ranges according to the present invention, are obtained after the heat treatment at any temperature of 400 to 570° C. of the present invention. Moreover, it is seen that $B_r/B_{8000}$ of not less than 0.70 is obtained more reliably after heat treatment at 470 to 530° C., which is considered as a preferable range according to the present invention.

In the same way, FIG. 16 shows an influence of the temperatures of the heat treatment on the magnetic properties of raw materials for the semi-hard magnetic material Nos. 3 to 7 with the amount of Ni fixed to approximately 15% and the amouant of Mo changed in a range of 2.03 to 5.95%.

The dependence on the heat treatment temperatures of the respective properties of $B_r$, $B_r/B_{8000}$, $H_c$ has a tendency similar to that in FIG. 15. Furthermore, the respective characteristic values vary depending on the amount of Mo. As the amount of Mo increases, Br decreases but Hc increases.

When attention is focused on the relationship between the temperature of the heat treatment and the magnetic characteristics, a coercive force of 1000 to 5600 A/m and $B_r/B_{8000}$ of not less than 0.70, which are considered as preferable ranges according to the present invention, are obtained after the heat treatment at any temperature of 400 to 570° C. of the present invention. Moreover, it is seen that $B_r/B_{8000}$ of not less than 0.70 is obtained more reliably after the heat treatment at 470 to 530° C., which is considered as a preferable range.

FIG. 17 shows an influence of the temperatures of the heat treatment on the magnetic properties of raw materials Nos. 9 to 12 with the amount of Ni fixed to approximately 20% and the amount of Mo changed in a range of 2.10 to 5.08%.

The dependence of the temperatures of the heat treatment on the respective properties of $B_r$, $B_r/B_{8000}$, $H_c$ has a tendency similar to that in FIGS. 15 and 16.

When attention is focused on the relationship between the temperatures of the heat treatment and the magnetic characteristics, a coercive force of 1000 to 5600 A/m and $B_r/B_{8000}$ of not less than 0.70, which are considered as preferable ranges, are obtained after the heat treatment at any temperature of 400 to 570° C. of the present invention. Moreover, it is seen that $B_r/B_{8000}$ of not less than 0.70 is obtained more reliably after heat treatment at 470 to 530° C. which is considered as a preferable range.

It is seen from the above described examples that the semi-hard magnetic material of the present invention manufactured by setting the chemical compositions of raw materials for the semi-hard magnetic material in the range of the present invention and using the method specified by the present invention can obtain a coercive force of 1000 to 5600 A/m and a high squareness ratio ($B_r/B_{8000}$) of not less than 70, and is applicable, for example, as a bias material for a crime prevention sensor.

The invention claimed is:

1. A method of manufacturing a semi-hard magnetic material comprising, sequentially:

a step of preparing a raw material for the semi-hard magnetic material consisting essentially of 10.0 to 25.0% of Ni, 2.0 to 6.0% of Mo and the balance being Fe and inevitable impurities, in mass %;

a step of heat treating or hot working the raw material so that the heat treated or hot worked raw material has not less than 90% of martensitic structure;

a step of cold working the heat treated or hot worked material at a reduction of area of not less than 50% so that the thus cold worked material has an extended structure including not less than 95% of martensitic structure; and a step of heat treating the cold worked material in a range of 400 to 570° C. so as to generate more than 0% but less than 30.0% of reverse-transformed austenitic structure.

2. The method according to claim 1, wherein an amount of Ni of the raw material is 15.0 to 22.0% in mass %.

3. The method according to claim 1, wherein an amount of Mo of the raw material is 3.0 to 5.5% in mass %.

4. The method according to claim 1, wherein the heat treatment or hot working to the raw material is performed at higher than 700° C. but not higher than 1200° C.

5. The method according to claim 1, wherein the heat treatment or hot working to the raw material is performed at 800 to 1150° C.

6. The method according to claim 1, wherein the heat treatment to the raw material is performed at 800 to 1000° C.

7. The method according to claim 1, wherein a reduction of area in the cold working is not less than 70%.

8. The method according to claim 1, wherein a reduction of area in the cold working is not less than 90%.

9. The method according to claim 1, wherein the heat treatment for generating the reverse transformed austenitic structure is performed in a range of 470 to 530° C.

10. The method according to claim 1, wherein the heat treatment for generating the reverse transformed austenitic structure is performed in a range of 490 to 520° C.

11. The method according to claim 1, wherein the heat treatment for generating the reverse transformed austenitic structure is performed for not less than 10 minutes.

12. The method according to claim 1, wherein 5% to 25.0% of reverse transformed austenitic structure is generated through heat treatment for generating the reverse transformed austenitic structure.

13. The method according to claim 1, wherein the hot working is performed at 900 to 1150° C.

* * * * *